US005700616A

United States Patent [19]

Kasuya et al.

[11] Patent Number: 5,700,616

[45] Date of Patent: Dec. 23, 1997

[54] DEVELOPER FOR DEVELOPING AN ELECTROSTATIC IMAGE AND IMAGE FORMING METHOD

[75] Inventors: Takashige Kasuya, Soka; Osamu Tamura, Kawasaki; Hiroshi Yusa, Machida; Takakuni Kobori, Kawasaki; Masaichiro Katada, Soka, all of Japan

[73] Assignee: Canon Kabushiki Kaisha, Tokyo, Japan

[21] Appl. No.: 594,795

[22] Filed: Jan. 31, 1996

[30] Foreign Application Priority Data

| | | | |
|---|---|---|---|
| Feb. 1, 1995 | [JP] | Japan | 7-015061 |
| Sep. 20, 1995 | [JP] | Japan | 7-264624 |

[51] Int. Cl.[6] ..... G03G 9/097

[52] U.S. Cl. ..... 430/110; 430/126

[58] Field of Search ..... 430/110, 111, 430/137, 126

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 5,270,770 | 12/1993 | Kukimoto et al. | 355/274 |
| 5,376,172 | 12/1994 | Tripp et al. | 106/490 |
| 5,424,810 | 6/1995 | Tomiyama et al. | 355/251 |
| 5,447,815 | 9/1995 | Kato et al. | 430/110 |

FOREIGN PATENT DOCUMENTS

| | | | |
|---|---|---|---|
| 0395061 | 10/1990 | European Pat. Off. | G03G 15/16 |
| 0431737 | 6/1991 | European Pat. Off. | G03G 9/097 |
| 0541113 | 5/1993 | European Pat. Off. | G03G 9/08 |
| 43-24748 | 10/1968 | Japan . | |
| 42-23910 | 11/1968 | Japan . | |
| 49-42354 | 4/1974 | Japan . | |
| 55-26518 | 2/1980 | Japan . | |
| 58-60754 | 4/1983 | Japan . | |
| 59-46664 | 3/1984 | Japan . | |
| 61-249059 | 11/1986 | Japan . | |
| 61-277964 | 12/1986 | Japan . | |
| 4-264453 | 9/1992 | Japan . | |

*Primary Examiner*—John Goodrow

*Attorney, Agent, or Firm*—Fitzpatrick, Cella, Harper & Scinto

[57] ABSTRACT

A developer for developing an electrostatic image has a toner which contains a particulate toner, a particulate silica A and a particulate silica B. The toner has a weight-average particle size of not larger than 12.0 μm and a particle-number distribution showing not more than 50% of toner particles not larger than 4.0 μm in particle size and not more than 10% of toner particles not smaller than 10.08 μm in particle size, each of the toner particles having a toner composition containing at least a polymer component and a charge controlling agent. The particulate silica A is composed of silicone oil-treated silica particles and has an average particle size of not larger than 0.1 μm, while the particulate silica B is composed of silicone oil-treated silica particles and has an average particle size of 0.5 to 50 μm. The particulate silica B also has a particle-number distribution showing not more than 50% of silica particles not larger than 1.0 μm in particle size and not more than 10% of silica particles not smaller than 100 μm in particle size. Also disclosed is an image forming method which uses this developer.

38 Claims, 5 Drawing Sheets

DEVELOPER FOR DEVELOPING AN ELECTROSTATIC IMAGE AND IMAGE FORMING METHOD

BACKGROUND OF THE INVENTION

1. Field of the Invention

This invention relates to developers for use in developing an electrostatic image by an image forming process such as electrophotography or electrostatic printing. Further, the invention relates to an image forming method using such a developer.

2. Related Background Art

A number of processes for electrophotography are known as disclosed for instance in U.S. Pat. No. 2,297,691 and Japanese Patent Publication Nos. 42-23910 and 43-24748. In general, an electrostatic image is formed on a photosensitive material by use of a photo-conductive substance in numerous ways and thereafter is developed with a toner into a toner image which may be transferred, if necessary, to a transfer material such as paper, followed by fixing of the toner image with either one or both of heat and pressure, or solvent vapor. Thus, a particular copy or print is obtained. Those process steps are repetitiously effected after the toner remaining untransferred on the photosensitive material is cleaned in various ways.

Recently, copiers or printers for use in the electrophotography have been strictly required to be dimensionally small, sufficiently lightweight, speedily operable and highly reliable. Toners have also been required to afford higher performance to cope with a keen demand noted for formation of a highly minute and quality image.

As regards the fixing step, a toner system needs to be fixable at low temperature so as to attain a fixing process that allows for shortened waiting time and reduced electricity consumption.

Numerous electrifying processes of a contact type (a roller, brush, blade and the like) have lately been proposed in which electrification is conducted by bringing an electrifying member, for example, an electrophotographic photosensitive member, into contact with a voltage derived from superposition of direct and alternating current voltages on each other. Such a process has the advantage that a lower voltage can be used than in a conventional electrifying process of corona type and that less ozone is generated. In this contact-type electrifying process, as shown for instance in FIG. 2 of the accompanying drawings, a roller 2 as an electrifying material is rotatably driven in contact with an electrophotographic photosensitive drum 1, while a voltage ($V_{ac}+V_{dc}$) derived from superposition of an alternating current voltage $V_{ac}$ on a direct current voltage $V_{dc}$ is being applied to that drum so that the photosensitive drum can be uniformly electrified.

However, such a system where an electrifying member is contacted with an electrophotographic photosensitive drum tends to involve deposition on the drum due to melt adhesion of toner having passed through a cleaner as well as filming on the drum due to nucleation of external additives liberated from toner. These problems become severer as the copying process is rendered speedier, meaning that the use of a toner system having higher fixing performance is disadvantageous.

Turning to the transferring step, Japanese Patent Laid-Open No. 59-46664 is cited to show an image forming apparatus including a step of electro-statically transferring a toner image formed on an electrostatic image carrier to a sheet-like transfer material mostly of paper. This publication teaches that an endless electrostatic image carrier of a rotatable cylindrical form or an endless belt form is allowed to travel in press-contact with a bias-applied transferring device with a transfer material passing through between the carrier and the device, thereby transferring the toner image on the carrier to the transfer material.

The apparatus stated above is in strong contrast with conventionally prevalent transfer means utilizing corona discharging. More specifically, a region where the transfer material is adsorbable relative to the electrostatic image carrier can be enlarged by adjusting the force of press-contact of the transfer roller with the carrier so that the transfer material is held in positively pressed condition at a location of transfer. This alleviates synchronism failure depending upon transport means for the transfer material and transfer deviation resulting from looping or curling of the transfer material. Hence, good adaptability is attained to shortened transport path for a transfer material and to reduced diameter of an image carrier, both of which are called for in keeping pace with recently predominant downsizing of the image forming apparatus in question.

Conversely, however, the contact-transfer type apparatus requires pressing to some extent since transfer current is supplied at a contact portion. In this instance, the toner image on the electrostatic image carrier also gets pressed, resulting in toner cohesion. When the electrostatic image carrier on its surface is formed of a resin, adhesion takes place at between the cohered toner and the carrier with the results that the toner firmly adheres to the front side of the carrier, or to the back side of the contact material of the transfer device. Such a phenomenon of toner adhesion is responsible for void formation of an electrostatic image on the associated carrier and transfer failure of the image, hence for defective image copying.

Generally, a toner undergoes fixing to a transfer material by means of hot melt transfer using a hot roller or a radial heat, or pressure transfer using a pressure roller. From standpoints of economy as well as safety and designability of an apparatus to be employed, the amounts of heat and pressure to be applied are preferred to be rather smaller. To this end, the toner generally contains components which are low in melt viscosity, melting point and pressure yield point and also are soft in nature. It is important, however, that the toner should also have incorporated hard components with respect to durable strength and fixing offset.

To meet the above dilemmatic requirements, it may be advantageous in many cases that a toner-constituting binder resin has in its molecular-weight distribution two, soft and hard, component portions. The toner so composed, however, is liable to objectionably markedly facilitate the drawbacks noted above in connection with the contact-type transferring device. This leaves the problem that such a toner system is difficult to make feasible when its adaptability to such contact-type device is taken into account.

A further demand is directed to a toner system that exhibits high transferability, thus meeting lately sought requirements for speedy operability, quality imaging or omission of a cleaning step owing to simplified apparatus, and also offers good fixing, thus eliminating the aforesaid problems, namely melt adhesion and filming.

To gain quality imaging, research has been made on toners with respect to fluidity, electrostaticity, environmental stability and treatment of various inorganic oxides in particulate form.

For instance, Japanese Patent Laid-Open Nos. 49-42354 and 55-26518 each disclose a toner improved particularly in respect of fluidity by treating a powdery material such as silica or the like with silicone oil.

Japanese Patent Laid-Open No. 58-60754 teaches a toner containing a silicone oil-treated wet silica, and Japanese Patent Laid-Open No. 61-277964 teaches a toner containing a silica treated with silicone oil and having a degree of hydrophobicity of more than 90%. One of the latter two toners has been improved in its fluidity and the other in its electrostaticity.

The additives to the toners employed here are wholly unsatisfactory in regard to predominant needs for quality imaging, high transfer- ability, high durability and environmental stability.

In particular, those known additives do not serve to further alleviate fogging on the image, nor improve transferability nor solve the foregoing difficulties experienced when an electrifying or transferring process of a contact type is employed.

In Japanese Patent Laid-Open No. 61-249059, a magnetic toner is disclosed which has supported thereon a hydrophilic silica and a hydrophobic silica treated with silicone oil so as to alleviate image fogging. For similar purposes, Japanese Patent Laid-Open No. 4-264453 discloses the use in an AC-applied developing system of a toner having a particulate inorganic oxide surface-treated with silicone oil and having a BET-specific surface area of 10 to 100 $m^2/g$ and a particulate inorganic oxide having a BET-specific surface area of larger than 100 $m^2/g$.

Such prior art toners are still unsatisfactory, like the toners referred to above, since they fail to give high transferability and to clear up the contact-type electrifying or transferring process-related problems stated above. Those toners are also insufficient as to electrification stability in high speed printing and environmental stability.

SUMMARY OF THE INVENTION

Taking into account the foregoing problems of the prior art, an object of the present invention is to provide an improved developer for developing an electrostatic image that exerts quality imaging (least fogging and sufficient electrification stability), high transferability, high durability and environmental stability.

Another object of the invention is to provide such a developer that is highly capable of solving problems (melt adhesion and filming) arising from use of a contact-type electrifying process or a contact-type transferring process.

Still another object of the invention is to provide such a developer that satisfies fixing of toner at low temperature, durability and electrification stability in high speed operation of the associated apparatus.

Still another object of the invention is to provide such a developer that early initiates electrification.

A further object of the invention is to provide an image forming method using such a developer that prevents filming on an elecrostatic image carrier.

Still another object of the invention is to provide such a method that produces stable developing characteristics even under elevated temperature and humidity conditions.

Still another object of the invention is to provide such a method that prevents electrostatic offset.

According to one important aspect of the invention, there is provided a developer for developing an electrostatic image which comprises a toner comprising a particulate toner, a particulate silica A and a particulate silica B, the toner having a weight-average particle size of not larger than 12.0 μm and a particle-number distribution showing not more than 50% of toner particles not larger than 4.0 μm in particle size and not more than 10% of toner particles not smaller than 10.08 μm in particle size, each of the toner particles being formed of a toner composition comprising at least a polymer component and a charge controlling agent, the particulate silica A being composed of silicone oil-treated silica particles and having an average particle size of not larger than 0.1 μm, the particulate silica B being composed of silicone oil-treated silica particles and having an average particle size of 0.5 to 50 μm and a particle-number distribution showing not more than 50% of silica particles not larger than 1.0 μm in particle size and not more than 10% of silica particles not smaller than 100 μm in particle size, the particulate silica A and particulate silica B meeting the following requirements, (a) the average particle size $D_B$ of the particulate silica B is 10 times or more larger than the average particle size $D_A$ of the particulate silica A, (b) the silicone oil amount $W_B$ used to treat the particulate silica B is twice or more larger than the silicone oil amount $W_A$ used to treat the particulate silica A, and (c) the particulate silica A is added in an amount 3 times or more larger than the particulate silica B with respect to the toner particles (based on weight).

According to another important aspect of the invention, there is provided an image forming method comprising electrifying an electrostatic image carrier, exposing the electrified carrier to light so as to form an electrostatic image thereon, developing the resulting image into a toner image, transferring the toner image to a transfer material optionally through an intermediate transfer material, and subsequently fixing the image on the transfer material by application of heat and pressure, wherein the developer comprises a toner comprising a particulate toner, a particulate silica A and a particulate silica B, the toner having a weight-average particle size of not larger than 12.0 μm and a particle-number distribution showing not more than 50% of toner particles not larger than 4.0 μm in particle size and not more than 10% of toner particles not smaller than 10.08 μm in particle size, each of the toner particles being formed of a toner composition comprising at least a polymer component and a charge controlling agent, the particulate silica A being composed of silicone oil-treated silica particles and having an average particle size of not larger than 0.1 μm, the particulate silica B being composed of silicone oil-treated silica particles and having an average particle size of 0.5 to 50 μm and a particle-number distribution showing not more than 50% of silica particles not larger than 1.0 μm in particle size and not more than 10% of silica particles not smaller than 100 μm in particle size, the particulate silica A and particulate silica B meeting the following requirements, (a) the average particle size $D_B$ of the particulate silica B is 10 times or more larger than the average particle size $D_A$ of the particulate silica A, (b) the silicone oil amount $W_B$ used to treat the particulate silica B is twice or more larger than the silicone oil amount $W_A$ used to treat the particulate silica A, and (c) the particulate silica A is added in an amount 3 times or more larger than the particulate silica B with respect to the toner particles (based on weight).

DETAILED DESCRIPTION OF THE INVENTION

Figure 1:
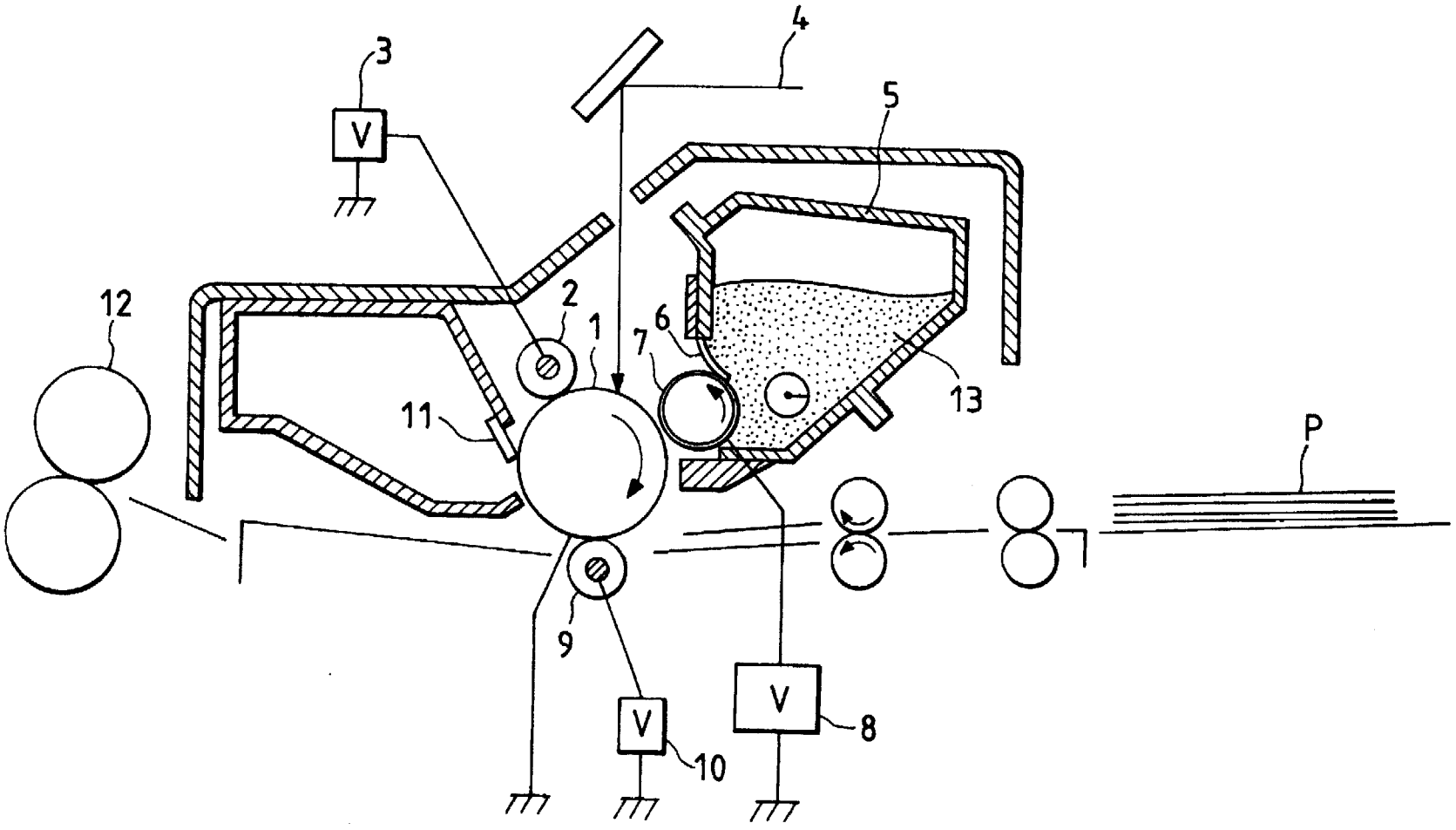
FIG. 1 is a schematic view explanatory of a preferred form of apparatus used for carrying out the image forming method of the present invention.

The present inventors have now found that the objects of the present invention as set forth hereinbefore, i.e., good electrification, quality imaging, high transfer-ability and high durability in particular, can be achieved with the use of the following specific toner.

The toner according to the invention comprises toner particles each being formed of a toner composition comprising at least a polymer component and a charge controlling agent. The toner has a weight-average particle size of not larger than 12.0 μm, preferably not larger than 10 μm, and a particle-number distribution showing not more than 50%, preferably not more than 30%, of toner particles not larger than 4.0 μm in particle size and not more than 10%, preferably not more than 5%, of toner particles not smaller than 10 μm in particle size. The toner includes a particulate silica A treated with at least silicone oil and a particulate silica B treated with at least silicone oil, the silica A having an average particle size of not larger than 0.1 μm, the silica B having an average particle size of 0.5 to 50 μm and a particle-number distribution showing not more than 50%, preferably not more than 30%, of silica particles not larger than 1.0 μm in particle size and not more than 10%, preferably not more than 5%, of silica particles not smaller than 100 μm in particle size. The average particle size $D_B$ of the silica B is 10 times or more larger than the average particle size $D_A$ of the silica A, the silicone oil amount $W_B$ used to treat the silica B is twice or more larger than the silicone oil amount $W_A$ used to treat the silica A, and the amount of the silica A added to the toner particles (based on weight) is 3 times of more larger than that of the silica B.

The particle size distribution of the toner is measured by means of a Coulter Multisizer tester (Coulter Inc.), details of which are described below.

A Coulter Multisizer tester (manufactured by Coulter Electronics Inc.) is connected to an Interface device (Nikkaki Co.) that outputs particle-number and volume distributions and also to a PC 9801 personal computer (NEC Corp.). An aqueous solution of 1% NaCl is prepared as an electrolyte with use of 1st grade sodium chloride. For example, ISOTON R-II (Coulter Scientific Japan, Co.) may be used as a commercial product. A measuring liquid is derived by incorporating 0.5 to 5 ml of a surfactant, preferably an alkylbenzene sulfonate salt, as a dispersant and 2 to 20 mg of a test toner in 100 to 150 ml of the above electrolyte solution. The solution having the test toner suspended therein is dispersed in an ultrasonic dispersing device for about 1 to 3 minutes. By use of the Coulter Multisizer tester with an aperture set at 100 μm, the volume and number of toner particles not smaller than 2 μm are measured, from which the volume and particle distributions are given, and then a weight-average particle size of the toner is determined.

The average particle size of the silica A is calculated from the following equation with true specific gravity and specific surface area as parameters.

$$d=6000/\rho\times S_{BET}$$

where d: average particle size ($\times 10^3$ μm)

ρ: true specific gravity (g/cm$^3$)

$S_{BET}$: BET-specific surface area (m$^2$/g)

The average particle sizes counted from BET-specific surface areas are not adequate for porous materials, but acceptably applicable to the particulate silica according to the invention since the silica is surface-treated with oil. The particle sizes of the silica A are fully consistent with the results obtained by electron microscopic examination.

The BET method is followed in determining the specific surface area of the silica A. With use of a specific surface area tester, Autosope 1 (Yuasa Ionics Co.), the test specimen is allowed to adsorb on its surface nitrogen gas, and the specific surface area is counted by the BET multi-plotting mode.

If the particulate silica A is admixed with the toner particles, the average particle size of that silica may be defined by measuring particles not smaller than 0.05 μm in particle size on a scanning-type electron microscope (SEM) and a transmission-type electron microscope (TEM).

To define the particle size distribution of the particulate silica B, silica particles of a particle size range of from 0.05 to 200 μm are measured in 32 logarithmic divisions [i.e. (log 200–log 0.05)/32] with use of a dry-type, laser diffraction-type particle size tester, HEROS (Nippon Denshi Co.). In this way, a 50%-average particle size is counted and defined as the average particle size of the silica B.

In order to practice the present invention, it is important to specify the particle size distributions of the toner and of the particulate silicas A and B both treated with silicone oil. This contributes greatly to improved electrification stability of the toner, hence quality imaging and high durability of the toner. Also importantly, the average particle size of the toner, the average particle sizes of the silicone oil-treated silicas A and B, the amounts of the oil to be used to treat both silicas and their amounts to be added to the toner particles should be specified to further enhance electrification stability and to attain high transfer-ability.

As for the particle sizes of the oil-treated silicas A and B, it is preferred to set the difference between larger and smaller particles to be greater than 10 times.

The average particle size of the oil-treated particulate silica A is 0.1 μm or less, preferably from 0.002 to 0.05 μm, whereas the average particle size of the oil-treated particulate silica B is from 0.5 to 50 μm, preferably from 3 to 20 μm. The average particle size is preferred to satisfy $10A \geqq B$. When the difference between the particle sizes of the silicas A and B is smaller than 10 times, it would render the toner insufficiently fluid, thus leading to reduced transferability.

The oil-treated particulate silica A of a smaller particle size serves for giving high fluidity of the toner and good releasability of the toner itself from an electrophotographic photosensitive material. The oil-treated particulate silica B of a larger particle size, upon addition to the silica A, acts to supply the oil to the surface of the photosensitive material and also to sterically reduce the adhesive force of the toner. Thus, the use of the silicas A and B in combination ensures high transferability.

Moreover, the surface of the electrophotographic photosensitive material and the corresponding contact material can be continuously oiled, preventing melt adherence of the toner to the photosensitive material as well as filming caused by external additives and the like. To this end, the larger particle-sized silica B should preferably contain silicone oil in twice or more as great amount as the smaller particle-sized silica A.

The amount of the oil used to treat the silica A is in the range of 1 to 30% by weight based on the weight of the oil-treated silica particles and that used to treat the silica B in the range of 30 to 90% by weight, preferably 40 to 65% by weight, based on the weight of the oil-treated silica particles. Departures from the difference in the amounts of the oil for both silicas would inhibit high transferability and high fluidity from being simultaneously attained.

The smaller particle-sized, oil-treated silica A should preferably be added to the toner in 3 times or more as great amount as the larger particle-sized, oil-treated silica B, the amount here being construed as the weight ratio. Failure to observe the relationship of $A \geqq B$ would result in reduced fluidity of the toner.

The silica A is incorporated in the toner in an amount of 0.3 to 3.0% by weight and silica B in an amount of 0.005 to 0.5% by weight, preferably 0.02 to 0.3% by weight.

In another preferred embodiment of the invention, the larger particle-sized silica B has a viscosity 10 times or more greater than the smaller particle-sized silica A. In addition, the viscosity of the oil used for the silica A is 1 to 1,000 cSt and that used for the silica B is 3,000 to 100,000 cSt. Observance of these oil viscosities leads to improved fluidity and transferability of the toner.

In a further preferred embodiment of the invention, the atomic ratio (Wo/Ws) of the Si atom induced from the silicone oil on the surface of the silicone oil-treated silica B relative to the Si atom induced from the matrix silica is preferably $1 \leqq Wo/Ws \leqq 10$.

Surface analysis may be performed by X-ray photoelectron spectroscopy (XPS).

The atomic ratio (Wo/Ws) according to the invention is determined by XPS under a set of conditions given below.

XPS apparatus: ESCALAB, 200-X, X-ray electron spectrometer (VG Co.)

X-ray source: Mg, Ka (300 W) analysis area: 2×3 mm

With the results of measurement, checking is made as to the number of Si atoms (103.7 eV) derived from the silica component ($SiO_2$) and the number of Si atoms of different chemical shifts derived from the silicone oil.

The above-defined atomic ratio denotes the amount of silicone oil on the surface of the oil-treated silica B. This ratio has been found to be well correlative with the amount of oil to be supplied on to an electronically electrophotographic photosensitive material.

The atomic ratio (Wo/Ws) if below 1 would invite insufficient supply of oil to the photosensitive material and its associated contact material and if above 10 would impair fluidity.

To make stable the quantity of a developer to be electrified, the toner particles and also the silicas A and B are preferred to have triboelectric characteristics of the same polarity and to provide equally polar triboelectric charges when in use. More preferably, both of the toner particles and the silicas A and B are by nature negative in their triboelectric characteristics.

Suitable silicas eligible for the purpose of the invention include so-called dry silicas derived from steam oxidation of silicon halogenide, dry silicas called fumed silicas, and wet silicas obtained from water glass and the like. For the silica B treated with more oil, wet silicas are preferred which are highly surface-porous and oil-absorptive. As concerns the smaller particle-sized, oil-treated silica A, dry silicas are preferred which are not rich in silanol groups present on the silica surface or in the particulate silicic acid and are free from by-produced residues such as $Na_2O$, $SO_3^{2-}$ and the like.

With respect to dry silicas, particulate complexes of silicas and other metal oxides can be obtained, in the process of silica formation, by adding to a silicon halogenite a different halogen compound such as aluminum chloride or titanium chloride. These complexes are also within the scope of the present invention.

Silicas used herein, particularly for a matrix silica for the oil-treated silica A, are preferred to be pretreated with an organic surface-treating agent which is chosen from a silane coupling agent or silylicating agent (an agent for imparting silyl groups) following of the formula, $$R_mSiY_n$$

where R is an alkoxy group or a chlorine atom, m is an integer of 1 to 3, Y is a hydrocarbon having an alkyl, vinyl, glycidoxy or methacryl group, and n is an integer of 3 to 1.

Typical examples include dimethyldichlorosilane, trimethylchlorosilane, allyldimethylchlorosilane, allyphenyldichlorosilane, benzyldimethylchlorosilane, vinyltrithoxysilane, gamma-methacryloxypropyl trimethoxysilane, vinyltriacethoxysilane, divinylchlorosilane, dimethylvinylchlorosilane and the like.

Eligible silylicating agents are those having a nitrogen-silicon bond which are selected from hexamethyldisilazane (HMDS), n-trimethylsilylimidazole, bis(trimethylsilyl)urea, trimethylsilylamide and bis-trimethylsilylacetoamide. HMDS is particularly suitable for pretreating the particulate silica A to render the latter hydrophobic.

Pretreatment of the particulate silicas with a silane coupling agent may be done in conventional manner, for example, by a dry method in which a particulate silica made like cloud by stirring is reacted with a gaseous silane coupling agent, or by a wet method in which a silica is reacted by dropwise addition of a silane coupling agent dispersed in a solvent.

Suitable silicone oils used in the invention are represented by the following formula,

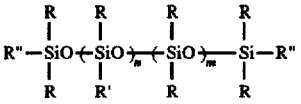

where R is an alkyl group of 1 to 3 carbon atoms, R' is an alkyl, halogen-modified alkyl or phenyl group, or a modified group of modified phenyl silicone oil, and R" is an alkyl group of 1 to 3 carbon atoms or an alkoxy group of 1 to 3 carbon atoms.

Examples include dimethyl silicone oil, alkyl-modified silicone oil, alpha-methylstyrene-modified silicone oil, chlorophenyl silicone oil, fluorine-modified silicone oil and the like.

Treatment of silicas with silicone oil may be effected as commonly known in the art, for example, by contact-mixing silica particles with silicone oil by means of a Henschel mixer, or by spraying silicone oil onto a base silica. Alternatively, silicone oil dissolved or dispersed in a solvent may be mixed with a base silica, and then the solvent is removed.

In still another preferred embodiment of the invention, a polymer component for the toner has an acid value of 1 or more, preferably 2 or more.

As a toner composition, the use of the oil-treated silicas combined with the polymer component having a given acid value is effective for earlier initiating electrification of the toner, and moreover, for improving electrification stability in high speed printing. Toner electrification has also been found to be improved even in such an environment as under elevated temperature and humidity conditions.

The toner composition according to the invention is preferred to be substantially free from THF insoluble matter. To be more specific, the content of the insoluble matter is not more than 5% by weight, preferably not more than 3% by weight, based on the total weight of the toner composition.

By the THF insoluble matter is meant a weight proportion of an undissolved polymer, mostly a crosslinked polymer, in a THF solvent in the toner composition. The insoluble matter is useful as a measure of a crosslink degree of the resin composition containing a crosslinked component. The THF insoluble matter is defined by the value measured as below.

A toner sample weighed to be from 0.5 to 1.0 g ($W_1$g) is put into a cylindrical filter paper (for instance, No. 86R, Toyo Filter Paper Co.) and set in a Soxhlet extractor. Extraction is conducted in a THF solvent for 6 hours. The resulting resin soluble matter is evaporated and then dried in vacuo for several hours, followed by weighing of THF soluble matter ($w_2$g). Components other than the resin, such as a magnetic material or pigment are taken as ($w_3$g). The THF insoluble matter is counted from the equation below.

$$\text{THF insoluble matter (\%)}=[\{w_1-(w_3+w_2)\}/(w_1-w_3)]\times 100$$

More than 5% by weight of the THF insoluble deteriorates fixing properties of toner.

The chromatogram of the THF soluble matter by gel permeation chromatography (GPC) should show a main peak in a region occupied by a molecular weight of at least $3\times10^3$ to $3\times10^4$, preferably $5\times10^3$ to $2\times10^4$, and a subpeak or shoulder in a region ranging in molecular weight from $1\times10^5$ to $3\times10^5$, preferably from $5\times10^5$ to $1\times10^6$.

In the GPC chromatogram, a polymer component of not smaller than $100\times10^4$ in molecular weight should have an area of 3 to 10%. The presence of such a THF-soluble component having a molecular weight not smaller than $100\times10^4$ leads to improved resistance to offset without deteriorating fixing at low temperature and, at the same time, to increase storage stability of the toner at high temperature.

In the present invention, the molecular weight distribution of the polymer component is determined by GPC under the conditions indicated below.

GPC measurement conditions of toner composition and polymer component apparatus: GPC-150C (Waters Co.)

column: XF801-7, 7-series (Showdex Co.)

temperature: 40° C.

solvent: THF (tetrahydrofuran)

flow rate: 1.0 ml/min specimen: injection of 0.1 ml of sample of a 0.05 to 0.6% by weight concentration The polymer component should preferably satisfy the relationship of $A_{VL}>A_{VH}$ where $A_{VL}$ is the acid value of a low-molecular weight polymer (a region of a molecular weight not smaller than $5\times10^4$ in the GPC chromatogram), and $A_{VH}$ is the acid value of a high-molecular weight polymer (a region of a molecular weight larger than $5\times10^4$ in that chromatogram). More preferably, the acid value ($A_{VL}$) of the low-molecular weight polymer defined above is from 21 to 35 mgKOH/g, whereas the acid value ($A_{VH}$) of the high-molecular weight polymer is from 0.5 to 11 mgKOH/g, the difference between both acid values being set at the equation, $$10\leq(A_{VL}-A_{VH})\leq 27$$

Because the polymer component of the toner particles is specified as defined above and is used together with the oil-treated silicas, toner electrification can be further enhanced. Also advantageously, it has been found that when comprised of two low- and high-molecular weight polymers which are formulated to have their respective acid values specified above, the resin composition of the toner is most effective in improving low temperature fixing, offset resistance and developing performance.

Low temperature fixing is dominated by the Tg and molecular weight distribution of the low-molecular weight polymer. When this low-molecular weight polymer contains two acid components and has a higher acid value at least by 10 mgKOH/g than the high-molecular weight polymer, it has been found that the Tg of the former polymer and its acid value defined by the molecular weight distribution act to provide a resin composition of a lower viscosity than a resin composition outside the above Tg and acid value ranges. The reason is that since the high-molecular weigjt polymer is set in its acid value to be lower at least by 10 mgKOH/g (0.5 to 11 mg KOH/g) than the low-molecular weight polymer, the molecular chains of both polymers would be presumably prevented to some extent from getting entangled with each other, and hence, low viscosity could be retained at low temperature and elasticity at high temperature. This leads to improved fixint at low temperature and sufficient developing characteristics on a high speed apparatus.

The difference between the acid vales of the low- and high-molecular weight polymers if greater than 27 would result in reduced miscibility of both polymers, hence insufficient offset resistance and developing performance.

The acid value of the low-molecular weight polymer if above 21 mgKOH/g exerts earlier initiation of toner electrification, but if more than 35 mgKOH/g would deteriorate environmental characteristics, particularly developing performance at high temperature.

The acid value of the high-molecular weight polymer if below 0.5 would give insufficient miscibility with low-molecular weight polymer (21 to 35 mg KOH/g in acid value), leading to impaired development performance, objectionable susceptibility to fogging in particular.

In the resin composition of the toner, the low- and high-molecular weight polymers should be admixed to satisfy the equation, $$W_L:W_E=50:50 \text{ to } 90:10$$

The range of admixture specified here should be strictly observed to improve fixing and offset resistance. Below 50% of the low-molecular weight polymer would be responsible for inadequate fixing. Less than 10% of the high-molecular weight polymer would result in reduced resistance to offset at high temperature.

In view of the relationship between the amounts of the low- and high-molecular weight polymers to be mixed and their acid values, the following equations should preferably be satisfied for reasons set forth hereinbelow.

$$A_{VL}\times W_L/(W_L+W_H)\geqq A_{VH}\times W_H/(W_L+W_H)\times 4$$

$$11\leqq 1/(W_L+W_H)(A_{VL}W_L+A_{VH}W_H)\leqq 30$$

If the amounts of the low- and high-molecular weight polymers and their respective acid values do not meet the above equation, i.e., if the acid value due to the low-molecular weight polymer in the whole resin is smaller than 4 times the acid value due to the high-molecular weight polymer in the whole resin, then the low- and high-molecular weight polymers would become excessively miscible with each other, thus failing to improve low viscosity at low temperature and high elasticity at high temperature. If $(1/W_L+W_H)(A_{VL}W_L+A_{VH}W_H)$ is less than 11, it would impair the build up of toner electrification and if above 30 it would adversely affect developing performance at high humidity.

The acid values (JIS acid values) of the low- and high-molecular weight polymers in the polymer component of the toner are determinable by the following method.

fractionation of components

[apparatus]

LC-908 (Nippon Bunseki Kogyo K.K)

JRS-86 (ditto; repeat injector)

JAR-2 (ditto; auto sampler)

FC-201 (Gilson Co.; fraction collector)

[column construction]

JAIGEL-1H-5H (20 mm in diameter×600 mm; fractionating column)

[measurement conditions]

temperature: 40° C.

solvent: THF flow rate: 5 ml/min detector: RI

A sample is pretreated to remove components other than the polymer component. With the previously determined elution time corresponding to the molecular weight of be $5\times10^4$, the low- and high-molecular weight polymers are fractionated before and after that. The fractions after being separated from the solvent are used as a specimen for measurement of the acid value.

measurement of acid values (JIS acid values)

1) A particulate specimen is precisely weighed in a 0.1 to 0.2 g amount, and that weight is taken as W (g).
2) The specimen is put into a 20 cc Erlenmeyer flask and dissolved with 10 cc of a mixed solvent of toluene-ethanol (2:1).
3) The resulting solution is incorporated with a few droplets of an alcohol solution of phenolphthalein as an indicator.
4) The solution in the flask is titrated with an alcohol solution of 0.1-N KOH by the use of a burette. The amount of the KOH solution used at this time is taken as S (ml). The same titration is done for a blank taken as B (ml) for blank testing.
5) The acid value is counted from the following equation.

$$\text{acid value}=(S-B)\times f\times 5.61/W$$

(f: factor of KOH solution)

The total acid value in the invention is measured as indicated below.

1) A sample is pretreated to remove components other than the polymer component. A particulate specimen is precisely weighed in an amount of about 0.2 g, and that weight is taken as W' (g).
2) The specimen is put into a 20-cc Erlenmeyer flask and incorporated with 9 cc of 1,4-dioxane, 3 cc of pyridine and 6 mg of 4-dimethylaminopyridine. The whole mixture is dissolved for one hour.
3) 1.1 cc of ion-exchanged water is added, and refluxing is conducted for 4 hours, followed by cooling.
4) A few droplets of an alcohol solution of phenolphthalein are added as an indicator.
5) The solution in the flask is titrated with a THF solution of 0.1-N KOH. The amount of the KOH solution used at this time is taken as S' (ml). B' (ml) is for blank testing.
6) The total acid value is counted from the following equation.

$$\text{acid value}=(S'-B')\times f'\times 5.61/W' \text{ (f': factor of KOH solution)}$$

The KOH solution in THF is prepared by dissolving 6.6 g of KOH in 20 cc of ion-exchanged water, followed by addition of 720 cc of THF and 100 cc of ion-exchanged water. Methanol is added with stirring until the solution becomes transparent.

Monomers for use in adjusting the acid value of the polymer component are chosen from acrylic acid such as acrylic acid, methacrylic acid, alpha-ethylacrylic acid and crotonic acid and alpha- or beta-alkyl derivatives thereof, and unsaturated dicarboxylic acids such as fumaric acid, maleic acid and citraconic acid and their monoester derivatives or anhyrous maleic acid. These monomers may be used singly or in combination and can be copolymerized with any other suitable monomer to thereby provide a polymer of a given acid value. Particularly preferred among such monomers are monoesters of unsaturated dicarboxylic acids.

Specific examples are chosen from monoesters of alpha, beta-unsaturated dicarboxylic acids such as monomethyl maleate, monoethyl maleate, monobutyl maleate, monoethyl maleate, monoallyl maleate, monophenyl maleate, monomethyl fumarate, monoethyl fumarate, monobutyl fumarate and monophenyl fumarate, monoesters of alkenyldicarboxylic acids such as n-butenylmonobutyl succinate, n-octenylmonomethyl succinate, n-butenylmonoethyl malonate, n-dodecenylmonomethyl glutarate and n-butenylmonobutyl adipate, and monoesters of aromatic dicarboxylic acids such as a monomethyl phthalate ester, a monoethyl phthalate ester and a monobutyl phthalate ester.

Those monomers structured to have a carboxyl group are added in an amount of 1 to 20% by weight, preferably 3 to 15% by weight, based on the total weight of the monomer of a high-molecular part of the binder resin (resin composition).

The above monoester monomers of dicarboxylic acids are advantageous in that although an acid monomer of higher solubility is not suitable for an aqueous suspension in suspension polymerization, an ester form is useful because of its lower solubility.

To implement the invention, the copolymer obtained as stated above may be alkali-treated to saponify its carboxylic acid group and carboxylate ester group. In such instance, the carboxylic acid or carboxylate ester group is converted to a polar functional group by the reaction with a cationic component contained in the alkali. Even if the high-molecular component of the binder resin contains a carboxylic group reactive with a metal-containing compound, crosslinking efficiency is decreased when such group is held anhydrous or closed-ring.

The alkali-treatment may be conducted, after production of a binder resin, by putting the copolymer as an aqueous solution of the alkali into a solvent employed for polymerization of the binder resin, and by stirring the system. Alkali hydroxide is useful in the invention includes hydroxides of alkaline metals and alkali earth metals such as Na, K, Ca, Li, Mg and Ba, hydroxides of transition metals such as Zn, Ag, Pb and Ni, and hydroxides of quaternary ammonium salts such as an ammonium salt, an alkylammonium salt and a pyridium salt, amongst which NaOH and KOH are particularly preferred.

The saponification reaction need not be complete, but may be partial as far as the carboxylic acid group and carboxylate ester group contained in the binder resin become converted to polar functional groups.

The amount of the alkali to be used for saponification is difficult to decide as it largely varies with the kind of polar groups present in the binder resin, the method of dispersion and the kind of monomers used. 0.02 to 5 times equivalent to the acid value of the binder resin are generally suitable. Below 0.02 time would fail to sufficiently proceed saponification, resulting in reduced number of polar functional groups being formed, eventually reducing subsequent crosslinking. Above 5 times would adversely affect functional groups such as carboxylate ester groups.

The resin composition should have a glass transition temperature (Tg) of 50° to 70° C., preferably 55° to 65° C., taking its storage stability in view. Lower Tg than 50° C. would make the toner deteriorative at elevated temperature and also render the toner susceptible to offset during fixing. Higher Tg than 70° C. would lead to insufficient fixing.

$Tg_L$ of the low-molecular weight polymer and $Tg_H$ of the high-molecular weight polymer in the resin composition should meet the following equation.

$$Tg_L \geqq Tg_H - 5 (°C.)$$

If $Tg_L$ is lower than $Tg_H$−5, developing performance would decline. $Tg_L \geqq Tg_H$ is more preferred.

The binder resin composition may be produced by a solution blend method in which low- and high-molecular weight polymers are formed independently by solution polymerization and thereafter mixed in solution condition, followed by removal of the solvent, by a dry blend method in which melt kneading is effected with a kneader such as an extruder, or by a two-stage polymerization method in which a solution-polymerized, low-molecular weight polymer is dissolved in a monomer used to form a high-molecular weight polymer, followed by suspension polymerization, washing and drying. The dry blend method is not satisfactory in respect of uniform dispersibility and compatibility of the polymers. The two-stage polymerization method is acceptable in uniform dispersibility, but disadvantageous in that the amount of a low-molecular weight polymer is difficult to increase over the amount of a high-molecular weight polymer and a high-molecular weight polymer contemplated under the invention is difficult to form in the presence of a low-molecular weight polymer, while undesired polymers of a lower molecular weight may be produced. Hence, the solution blend method is most suited for the purpose of the invention.

As methods of synthesizing the high-molecular weight polymer of the resin composition, polymerizations such as solution, emulsion and suspension can be used in the invention.

In emulsion polymerization, a substantially water-insoluble monomer is allowed to disperse as droplets in a water phase with use of an emulsifier. Reaction is performed in the presence of a water-soluble polymerization initiator. Reaction heat is easily adjustable. Because a phase in which to effect reaction (an oil phase comprised of polymer and monomer) is separated from a water phase, the rate of reaction termination is small, and therefore, the rate of polymerization is large so that a polymer of a high molecular weight is producible. Reaction steps are relatively simple, and the resulting polymer is by nature particulate. A polymer can be easily mixed with colorants, charge controlling agents and other additives required for toner production. This mode of polymerization is advantageous in some respects for producing a binder resin for use in a toner.

However, the resulting polymer is less pure due to an emulsifier used. Salting out and other modes of treatment are required to take out the polymer. Owing to these problems, suspension polymerization is a convenient alternative.

Suspension polymerization may be conducted such that a monomer is charged in an amount of 100 or less parts by weight (preferably 10 to 90 parts by weight) based on 100 parts by weight of an aqueous solvent. Eligible dispersants are chosen from polyvinyl alcohol, partially saponified polyvinyl alcohol, calcium phosphate and the like and are added in the range of 0.05 to 1 part by weight based on 100 parts by weight of the aqueous solvent. Reaction temperatures range from 50° to 95° C., but may vary depending upon the kind of initiators to be used and the nature of polymers to be formed.

To gain the high-molecular weight polymer of the resin composition according to the invention, the following polyfunctional and monofunctional polymerization initiators can be employed alone or in combination. The use of these initiators provides a polymer having a molecular weight of not less than $100\times10^4$ and a THF soluble of not less than 3% so that the fixing and offset resistance properties can be improved.

Polyfunctional polymerization initiators include those having contained in one molecule two more peroxide groups, such as 1,1-di-t-butylperoxy-3,3,5-trimethylcyclohexane, 1,3-bis-(t-butylperoxyisopropyl)benzene, 2,5-dimethyl-2,5-(t-butylperoxy)hexane, 2,5-dimethyl-2,5-di-(t-butylperoxy)hexyne-3, tris-(t-butylperoxy)-triazine, 1,1-di-t-butylperoxycyclohexane, 2,2-di-t-butylperoxybutane, 4,4-di-t-butylperoxyvaleric acid-n-butyl ester, di-t-butylperoxyhexahydro terephthalate, di-t-butylperoxy azelate, di-t-butylperoxytrimethyladipate, 2,2-bis-(4,4-di-t-butylperoxycyclohexyl)propane and 2,2-t-butylperoxyoctane, and those having contained in one molecule a peroxide group and a polymeric unsaturated group, such as diallyperoxy dicarbonate, t-butylperoxy maleate, t-butylperoxyally carbonate and t-butylperoxyisopropyl fumarate.

Particularly preferred among those compounds are 1,1-di-t-butylperoxy-3,3,5-trimethylcyclohexane, 1,1-di-t-butylperoxycyclohexane, di-t-butylperoxyhexahydro terephthalate, di-t-butylperoxy azelate, 2,2-bis-(4,4-di-t-butylperoxycyclohexyl)propane and t-butylperoxyally carbonate.

The polyfunctional initiators listed above may preferably be used in combination with monofunctional polymerization initiators in order to meet various properties required for a toner binder. In particular, monofunctional initiators are chosen from those having a lower decomposition temperature than that needed to obtain a half-life of 10 hours for a polyfunctional initiator.

Monofunctional polymerization initiators include organic peroxides such as benzoyl peroxide, 1,1-di(t-butylperoxy)-3,3,5-trimethylcyclohexane, n-butyl-4,4-di(t-butylperoxy) valerate, dicumyl peroxide, α-α'-bis (t-butylperoxydiisopropyl)benzene, t-butylperoxycumene, di-t-butyl peroxide; and azo and diazo compounds such as azobisisobuthylonitrile and diazoaminoazobenzene.

The monofunctional polymerization initiator can be added to a given monomer simultaneously with the addition of the mating polyfunctional counterpart. To maintain the initiation efficiency of the polyfunctional initiator at an appropriate level, however, the monofunctional initiator should preferably be incorporated after lapse of the reaction time equivalent to the half life brought about by the polyfunctional initiator under optional polymerization conditions.

The polymerization initiators, polyfunctional and monofunctional, are added in an amount of 0.05 to 2 parts by weight based on 100 parts by weight of the monomer with initiation efficiency in view.

The high-molecular weight polymer composition of the resin composition according to the invention may preferably be crosslinked with a crosslinkable monomer, examples of which are listed below.

Crosslinkable monomers used herein are mainly those having two more polymerizable double bonds contained therein. They are typified by aromatic divinyl compounds such as divinybenzene, divinylnaphthalene and the like; diacrylates bonded by alkyl chains, such as ethyleneglycol diacrylate, 1,3-butyleneglycol diacrylate, 1,4-butanediol diacrylate, 1,5-pentanedioldiacrylate, 1,6-hexanediol diacrylate and neopentylglycol diacrylate and those compounds having methacrylate substituted for acrylate; diacrylates bonded by ether bond-containing alkyl chains, such as diethyleneglycol diacrylate, triethyleneglycol diacrylate, tetraethyleneglycol diacrylate polyethyleneglycol #400 diacrylate, polyethyleneglycol #600 diacrylate and dipropyleneglycol diacrylate and those compounds having methacrylate substituted for acrylate; diacrylates bonded by aromatic group- and ether bond-containing chains, such as polyoxyethylene (2)-2,2-bis(4-hydroxyphenyl)propane diacrylate and polyoxyethylene (4)-2,2-bis(4-hydroxyphenyl) propane diacrylate and those compounds having metharylate substituted for acrylate; and polyester-based diacrylates such as for example MANDA (trade name; Nippon Kayaku Co.). Polyfunctional crosslinking agents include pentaerythritol acrylate, trimethylolethane triacrylate, trimethylolpropane triacrylate tetramethylolpropane triacrylate, tetramethylolmethane tetraacrylate and oligoester acrylate and those compounds having methacrylate substituted for acrylate; and triallyl cyanurate, triallyl trimellitate and the like.

The amount of the crosslinking agent to be added is not more than 1% by weight, preferably in the range of 0.001 to 0.05% by weight, based on 100% by weight of the other associated monomer.

With regard to the fixing and offset resistance properties of the toner, particularly preferred among those crosslinkable monomers are aromatic divinyl compounds, divinylbenzene in particular, and diacrylate compounds bonded by aromatic group- and ether bond-containing chains.

The high-molecular weight polymer of the resin composition may be previously admixed with a wax of a low molecular weight, thereby preventing phase separation in a micro region and re-cohesion of the high-molecular weight polymer, and hence, attaining good dispersion of the high-molecular weight polymer relative to the low-molecular weight polymer.

Suitable waxes of a low molecular weight are chosen from polypropylene wax, polyethylene wax, microcrystalline wax, carnauba wax, sazol wax, paraffin wax, higher alcohol type wax, ester wax and the like, oxides thereof and graft-modified thereof. They are solid at room temperature and have a weight-average molecular weight of not more than 30,000, preferably not more than 10,000.

The amount of the wax to be added is in the range of about 1 to 20 parts by weight based on 100 parts by weight of the binder polymer component.

For toner production, the wax can be previously mixed with the binder polymer component. In particular, at the time the polymer component is prepared, the wax and high-molecular weight polymer are first pre-dissolved in a solvent, after which the resultant solution is admixed with a solution of the low-molecular weight polymer. In view of dispersion efficiency, prevention of the resin from becoming denatured during stirring and handling convenience, the solid content of the polymer solution is from 5 to 70% by weight, whereas the preliminary solution of the high-molecular weight polymer and the polyolefin wax is from 5 to 60% by weight in solid content and the solution of the low-molecular weight polymer from 5 to 70% by weight in solid content.

Dissolution or dispersion of the high-molecular weight polymer and the law-molecular weight wax is conducted by mixing with stirring in a batch or continuous mode. To mix the low-molecular weight polymer solution with the preliminary solution of the high-molecular weight polymer and the wax, the former solution is added in an amount of 10 to 1,000 parts by weight based on 100 parts by weight of the solid content of that preliminary solution. In this instance, mixing is done in a batch or continuous mode of stirring.

Organic solvents for use in admixing the solutions of the resin composition include hydrocarbon solvents such as benzene, toluol, xylol, solvent naphtha No. 1, solvent naphtha No. 2, solvent naphtha No. 3, cyclohexane, ethylbenzene, solveso 100, solveso 150 and mineral spirit; alcohol solvents such as methanol, ethanol, iso-propyl alcohol, n-butyl alcohol, sec-butyl alcohol, iso-butyl alcohol, amyl alcohol and cyclohexanol; ketone solvents such as acetone, methyl ethyl ketone, methyl isobutyl ketone and cyclohexanone; ester solvents such as ethyl acetate, n-butyl acetate and cellosolve acetate; and ether solvents such as methyl cellosolve, ethyl cellosolve, butyl cellosolve and methyl carbitol, among which aromatic, ketone and ester solvents are particularly preferred. Those solvents may be used in combination.

In removing the organic solvent used to dissolve the polymers, the corresponding solution of the polymers may be heated to evaporate the solvent by from 10 to 80% by weight at atmospheric pressure. Residual solvent may be removed in vacuo. During that step, the organic solvent is preferably maintained at above the boiling point of the organic solvent but below 200° C. Temperatures lower than the boiling point of the solvent would lead to reduced efficiency for solvent removal and also would give objectionable shear stress to the polymers present in the organic solvent, thus facilitating re-dispersion of the polymers and causing phase separation in micro condition. Temperatures higher than 200° C. would facilitate depolymerization of the polymers and invite formation of oligomers due to molecular severing of the polymers, hence formation of a monomer. This would result in residual monomer in the product resin, rendering the resin inadequate as a toner for electronic photography.

The low-molecular weight polymer of the binder resin can be synthesized by methods in common use. In bulk polymerization, a polymer of a low molecular weight is obtained by polymerization at high temperature and making the rate of reaction termination earlier, but with difficulty in controlling the reaction. In solution polymerization, a low-molecular weight polymer is obtained under mild conditions by taking advantage of the difference in chain transfer of radicals due to a solvent used and also by adjusting the amount of a polymerization initiator and the reaction temperature. Hence, solution polymerization is suitably applicable to the formation of the low-molecular weight polymer according to the invention. This polymerization may also be carried out under pressurized conditions so as to minimize the amount of the initiator used and hold adverse effects of residual initiator to an absolute minimum.

Monomers for use in the high- and low-molecular weight polymers according to the invention include styrene derivatives such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene and isoprene; halogenated vinyls such as vinyl chloride, vinylidiene chloride, vinyl bromide and vinyl fluoride; vinyl esters such as vinyl acetate, vinyl propionate and vinyl benzoate; aliphatic monocarboxylate esters of alpha-methylene such as methyl methacrylate, ethyl methacrylate, propyl methacrylate, n-butyl methacrylate, isobutyl methacrylate, n-octyl methacrylate, dodecy methacrylate, 2-ethylhexyl methacrylate, stearyl methacrylate, phenyl methacrylate, dimethylaminoethyl methacrylate and diethylaminoethyl methacrylate; acrylate esters such as methyl acrylate, ethyl acrylate, n-butyl acrylate, isobutyl acrylate, propyl acrylate, n-octyl acrylate, dodecy acrylate, 2-ethylhexyl acrylate, steary acrylate, 2-chloroethyl acrylate and phenyl acrylate; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrol, N-vinylcarbazol, N-vinylindol and N-vinylpyrrolidone; vinyl naphthalenes; and acrylate or methacrylate derivatives such as acrylonitrile, methacrylonitrile and acrylamide. These vinyl monomers may be used singly or in combination. Particularly preferred are combinations of monomers that are capable of forming styrene-based copolymers and styrene-acryl copolymers.

Both of the low- and high-molecular weight polymers according to the invention should preferably contain in their respective polymer components at least a styrene polymer or a styrene-based copolymer in an amount of not less than 65 parts by weight based on 100 parts by weight of each of the polymer components. This leads to improved miscibility of the low- and high-molecular weight polymers.

The toner according to the invention may be a magnetic toner having particulate magnetic iron oxide contained. Suitable particulate magnetic iron oxides are such containing silicon atoms for their superior toner fluidity. When used in combination with the oil-treated silicas according to the invention, such a magnetic toner provides higher toner characteristics (earlier initiation of toner electrification).

The amount of the particulate magnetic iron oxide used for the magnetic toner is in the range of 20 to 200 parts by weight, preferably 30 to 150 parts by weight, based on 100 parts by weight of the binder resin.

The particulate magnetic iron oxide may be treated where desired with a silane coupling agent, a titanium coupling agent, a titanate, aminosilane or an organic silicon compound.

Eligible silane coupling agents to be used for surface tretment of the particulate magnetic iron oxide include hexamethyldisilazane, trimethylsilane, trimethyldhlorosilane, trimethylethoxysilane, dimethyldichlorosilane, methyltrichlorosilane, allydimethylchlorosilane, allyphenyldichlorosilane, benzyldimethylchlorosilane, bromomethyldimethylchlorosilane, alpha-chloroethyltrichlorosilane, beta-chloroethyltrichlorosilane, chloromethyldimethylchlorosilane, triorganosilanemercaptan, trimethylsilylmercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane and 1,3-diphenyl-tetramethyldisiloxane.

Suitable titanium coupling agents are chosen from isopropoxytitanium triisostearate, isopropoxytitanium dimethacrylate isostearate, isopropoxytitanium tridodecylbenzene sulfonate, isopropoxytitanium trisdioctyl phosphate, isopropoxytitanium tri-N-ethylamino-ethyl aminate, titanium bisdioctylpyrrophosphateoxy acetate, bisdioctyl phosphate ethylenedioctyl phosphite and di-n-butoxy bistriethanol aminate titanium.

Suitable silicon compounds are silicone oils having a viscosity of 30 to 1,000 cSt at 25° C., examples of which are dimethylsilicone oil, methylphenylsilicone oil, alpha-methyl-modified silicone oil, chlorophenylsilicone oil and fluorine-modified silicone oil.

The electrostatic image developing toner according to the invention may include as non-magnetic colorants pigments or dyes in common use such as carbon black and copper phthalocyanine.

When the electrostatic image developing toner according to invention is of a negative charge toner, a chelate of a monoazo dye and a chelate or metal salt of salicylic acid, an alkyl- salicylic acid, a dialkylsalicylic acid or naphthoic acid is suitably used as a charge controlling agent.

Eligible negative charge controlling agents exemplified below.

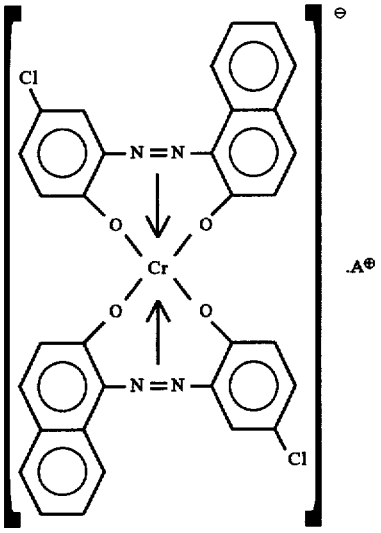
where $A^+$ is $H^+$, $Na^+$, $K^+$ or $NH_4^+$, or combined ions thereof.
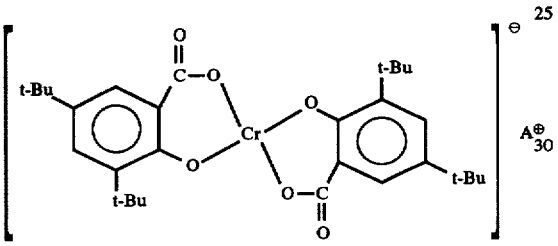
where t-Bu is a t-butyl group.
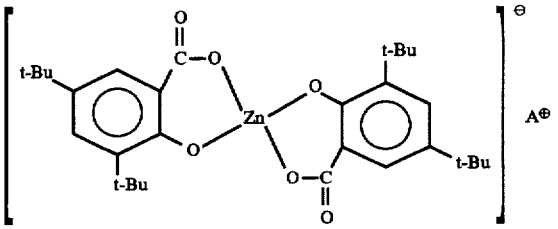
The following 3 compounds are more effective for a negative charge controlling agent in combination with the magnetic iron oxide set forth hereinabove.
1) monoazo type iron chelates of the formula below:
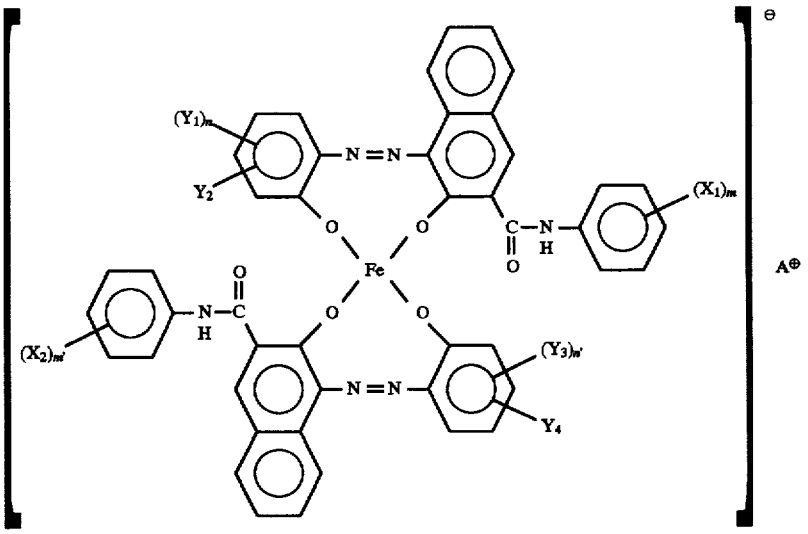

where $X_1$ and $X_2$ each are a hydrogen atom, a lower alkyl, lower alkoxy or nitro group, or a halogen atom, m and m' each are an integer of 1 to 3, $Y_1$ and $Y_3$ each are a hydrogen atom or an alkyl group of 1 to 18 carbon atoms, an alkenyl group of 2 to 18 carbon atoms, sulfonamide, mesyl, sulfonic acid, a carboxyl ester, a hyroxyl group, an alkoxy group of 1 to 18 carbon atoms, an acetylamino group, a benzoyl group, an amino group or a halogen atom, n and n' each are an integer of 1 to 3, $Y_2$ and $Y_4$ are a hydrogen atom or an nitro group, $X_1$ and $X_2$, m and m', $Y_1$ and $Y_3$, n and n', and $Y_2$ and $Y_4$ each are identical or different, and $A^+$ is $H^+$, $Na^+$, $K^+$ or $NH_4^+$, or combined ions thereof.

2) compounds of an aromatic hydroxy-carboxylic acid, an aromatic diol or an aromatic dicarboxylate derivative with an iron atom, and of the formula below:

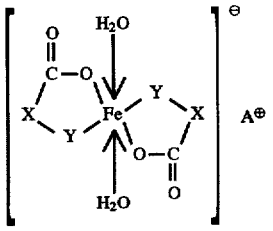

where X is

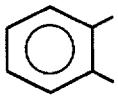

which may have a substituted group such as an alkyl group and so on,

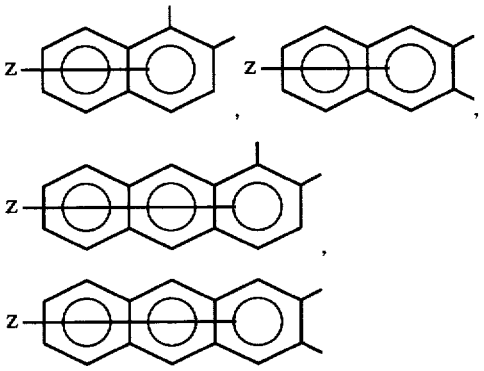

in which Z is a hydrogen or halogen atom, or a nitro group,

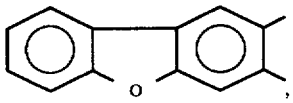

-continued

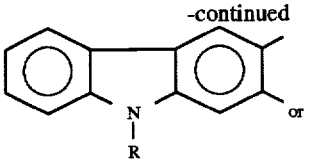

or

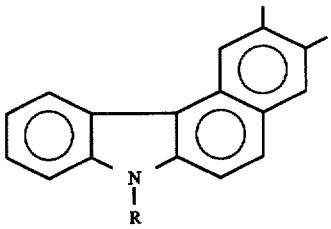

in which R is a hydrogen atom, or an alkyl group of 1 to 18 carbon atoms or an alkenyl group of 2 to 18 carbon atoms Y is —O— or

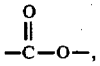

and $A^+$ is $H^+$, $Na^+$, $NH_4^+$ or aliphatic ammonium, or combined ions thereof.

3) N-N'-bisarylurea derivatives of the formula below:

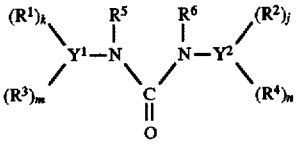

where $Y^1$ and $Y^2$ each are a phenyl, naphthyl or anthryl group, $R^1$ and $R^2$ each are a halogen atom, or a nitro, sulfonate, carboxyl, carboxylate ester, cyano, carbonyl, alkyl, alkoxy or amino group, $R^3$ and $R^4$ each are a hydrogen atom, or an alkyl, alkoxy, phenyl which may have a substituent, aralkyl which may have a substituent or amino group, $R^5$ and $R^6$ each are a hydrogen atom or an hydrocarbon group of 1 to 8 carbon atoms, k and j each are 0 or an integer of 1 to 3, both parameters being not zero at the same time, m and n each are a integer of 1 or 2, and $Y^1$ and $Y^2$, $R^1$ and $R^2$, $R^3$ and $R^4$, $R^5$ and $R^6$, k and j, and m and n each are identical or different.

Particularly preferred are monoazo type iron chelates of the formula below.

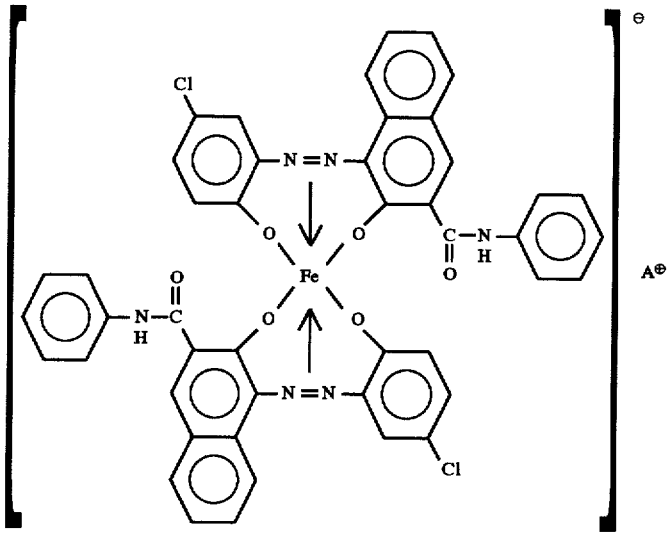

where $A^+$ is $H^+$, $Na^+$, $K^+$ or $NH_4^+$, or combined ions thereof.

Although the mechanism is not exactly known, it has now been found that when the negative charge controlling agent specified above is used in combination with a polymer component adjusted in its acid value, the quality of the resulting toner image (eliminated or alleviated fogging in particular) can be enhanced.

Further, positive charge controlling agents used herein include nigrosin and modified nigrosins of its aliphatic metal salts; quaternary ammonium salts such as tributylbenzylammonium-1-hydroxy-4-naphtosulfonate salt and tetra-butylammonium tetrafluoro borate, and onium salts such as their phosphonium salts and their chelates of those compounds; triphenymethane dyes and their lake pigments (a laking agent is phosphorus tungstic acid, phosphorus molydenic acid, phosphorus tungsten molybdenic acid, tannic acid, lauric acid, gallic acid, ferricyanide, ferrocyanide or the like; diorgano tin oxides such as dibutyltin oxide, dioctyltin oxide and dicyclohexyltin oxide; and diorganotin borates such as dibutyltin borate, dioctyltin borate and dicyclohexyltin borate. These compounds may be used alone or in combination.

The amount of the charge controlling agent to be added is from 0.1 to 5.0 parts by weight per 100 parts by weight based on the binder resin in view of a quantity of charge of the toner.

To produce the electrostatic image developing toner according to the invention, a given polymer component is fully mixed in a mixer such as a ball mill with as a colorant a dye, a pigment, a magnetic material and other additives. The resulting mixture is thereafter melted, mingled and kneaded with use of a heated kneading device such as a roll, a kneader or an extruder, whereby the polymers are allowed to become compatible with each other, followed by dispersion or melting of a pigment or dye as a colorant and a charge controlling agent. Subsequent cooling, solidification, pulverizerion and strict classification provide desired toner particles.

Alternatively, the electrostatic developing toner of the invention may be produced by a polymerization method. In this instance, a selected polymerizable monomer, a colorant, a charge controlling agent and a polymerization initiator (if necessary, a cross-linking agent and other suitable additives) are uniformly dissolved or dispersed to form a monomer composition. This composition is dispersed with a suitable stirrer into an aqueous medium containing a dispersion stabilizer and so polymerized to produce toner particles of a desired particle size. When the toner particles are made to contain a magnetic iron oxide by the polymerization method, the iron oxide is preferred to be previously made hydrophobic.

Referring to the drawings, the image forming method of the present invention will now be described below.

FIG. 1 illustrates an apparatus for electronic photography, an example of a copier or a printer for implementing the image forming method according to the invention. Contained in developing means 5 is a developer 13 of the invention that is magnetic or non-magnetic. In the case of use of an image forming apparatus other than that shown in FIG. 1, developing means may be constructed to receive a two-component developer having a toner and a carrier. A photosensitive member 1 is electrified on its front side with electrifying means 2 voltage-applied by bias-applying means 3, followed by exposure to light 4, whereupon an electrostatic image is formed on the photosensitive member 1. This photosensitive member 1 used here is exemplified by an OPC photosensitive drum and a photosensitive drum of an amorphous silicone or polycrystalline material, whereas the electrifying means 2 is exemplified by an electrifying roller, an electrifying brush, an electrifying blade and the like of a contact-electrification type. Laser light or a light emitted from a halogen lamp may be used as light exposure 4.

The electrostatic image is developed with the developer 13 accommodated in the developing means 5 having a developing sleeve 7 fitted thereto and a toner blade 6 such as an elastic or magnetic blade. The developing sleeve 7 has provided therein a magnetic field-generating means such as a magnet. Development is performed by a normal or reverse developing system. An alternating bias, a pulse bias and/or a direct bias are applied according to necessity to the developing sleeve 7 via bias-applying means 8. A transfer material P is transported to a transferring part where the transfer material P is subjected to electrification, while pressed from behind, opposite of the photosensitive member 1, by transferring means voltage-applied by bias-applying means 10, such as a transfer roller or a transfer belt. Thus, the toner image on the photosensitive member 1 is electrostatically transferred to the transfer material P. When it is desirable, the toner image on the photosensitive member 1 can be transferred to an intermediate transfer material such as an intermediate transfer drum, an intermediate transfer belt or the like (not shown), followed by transference of the toner image from the intermediate transfer material to the transfer material P.

The toner image on the transfer material P separated from the photosensitive member 1 is fixed by heat- and pressure-applying means 12 such as hot pressing roll means. Part of the toner having remained on the surface of the photosensitive member 1 after completion of the transferring step can if necessary be removed therefrom by cleaning means 11 such as cleaning blade, a cleaning roll, a cleaning brush or the like. The photosensitive member 1 thus cleaned is recycled for use at from the electrifying step by the electrifying means 2.

The photosensitive member 1 is generally composed of a photosensitive layer and an electrically conductive substrate. In use, the material 1 allowed to rotate in the direction indicated by the arrow in FIG. 1. The developing sleeve 7, provided with a non-magnetic cylindrical structure acting as a toner carrying member, is rotated at the developing part in the same direction as is the photosensitive member 1. In the developing sleeve 7, firmly supported is a multipolar permanent magnet (a magnet roll) as the magnetic field-generating means. A magnetic developing toner 13 contained in the developing means 5 is applied on the surface of the developing sleeve 7 by means of a coating blade 6 so that a triboelectricity is imparted to the toner by friction with the coating blade 6 and/or the surface of the developing sleeve 7. By the use of the coating blade 6, a developing layer for instance in a thickness of 10 to 300 μm is uniformly formed on to the surface of the developing sleeve 7. At the developing part, the developing sleeve 7 is applied with an alternating bias, for example, of a f in the range of 200 to 4,000 Hz and of a Vpp in the range of 500 to 3,000 V.

During toner transfer at the developing part, the toner moves to the electrostatic image by the action of both the electrostatic force on the surface of the photosensitive member and the alternating bias or the pulse bias.

Furthermore, the developer carrying member illustrated by the aforesaid developing sleeve may preferably be constructed as set forth below.

The developer carrying member has at least a substrate and a coating layer in which the substrate is coated with the coating layer. The coating layer is made preferably of a coating material containing (1) a solid lubricant or an electrically conductive agent, or a mixture thereof, and (2) a binder resin.

The binder resin for use in the coating layer on the developer carrying member is, for example, a phenol resin, an epoxy resin or a polycarbonate resin. Generally preferred are resins capable of imparting triboelectricity of positive polarity to the toner.

Thermosetting resins are preferable in productivity and durability. When electrification stability of the toner is taken in view, a phenol resin is most preferred. Included in phenol resins are pure phenol resins composed only of phenol and formaldehyde, and modified phenol resins composed of an ester gum and a pure phenol resin. Phenol resins are preferably used since they can produce a dense, three-dimensional crosslinked structure through a thermosetting reaction and hence form a notably hard coating as compared with other thermosetting resins such as polyurethane, polyamide and the like.

The substrate for use in the developer carrying member is preferably a metal and an alloy compound. Non-metal materials may also be utilized. Since the developer carrying member, for example the developing sleeve, is used as an electrode, when a non-metal material, for example, a plastic molding is employed as the substrate it is required to be electrically conductive. For instance, the non-metal material may be made electrically conductive by forming a metal film on that material by deposition.

The solid lubricant is preferably graphite. Both naturally occurring and artificial ones are useful. The particle size of graphite is difficult to define, as stated hereinbefore, owing to the flaky form of that material. Since graphite is variable in its shape during dispersion by stirring means such as a sand mill as described later, the range of particle sizes cannot be easily decided. However, graphite used in the invention preferably has a width of 100 μm or less as measured longitudinally along the cleavage plane thereof.

Most preferred as the method of width measurement is direct examination of a graphite specimen under a microscope. A simpler measurement is to use a usual particle size distribution tester based on electric resistivity, precipitation, centrifugal or laser scattering, thereby counting the maximum distribution value.

The graphitization degree of graphite is preferably above 60%. This property affects the cleavage of graphite and is thought to affect the difference of coating property at an initial and an after-duration stages. Although the crystallinity of graphite is determinable by various methods, X-ray diffraction is common for evaluation with good reproducibility.

The electrically conductive agent is preferably carbon black. Both furnace- and channel-type ones may be used. In view of coatability, carbon black of a low resistivity is preferred which is particularly less than 0.5 Ω·cm in resistivity at a pressure of 120 kg/cm$^2$.

The amount W of carbon black to be added to 100 parts by weight of the binder resin should preferably meet the equation, $$W=[(\{100/(\text{oil absorption of carbon black})\}\times 100]\times a$$

where the oil absorption of carbon black is the absorption by 100 g of a carbon black specimen of dibutyl phthalate (cc/100 g) (ASTM D-2414-79), and the coefficient a is from 0.3 to 3. Several types of carbon black may be used in combination, and in such case, the oil absorption is determined by measurement of the mixture.

The method of producing the developer carrying member will be described below.

A coating agent is prepared by adding a starting coating material in a solid content of from 5 to 50% by weight into a solvent capable of solubilizing the binder resin, for example, for a phenol resin an alcohol solvent such as methanol or propyl alcohol. The resultant solution is stirred as by a sand mill, a ball mill or an attritor to thereby disperse the pigment content, whereby a mother coating liquid is provided. By adding of a solvent, the mother coating liquid is adjusted in its solid content to meet a given level, after which a coating liquid is obtained. This coating liquid is applied over a substrate of a developer carrying member and dried by finger pressing, followed by curing of the coating layer with heat or by light exposure, so that a desired developer carrying member is produced. Coating is done by spraying, dipping, roller coating, bar coating or electrostatic coating.

The following are the proportional ratios of the components for use in the developer carrying member. These ratios should be construed as particularly preferable.

Namely, the weight ratio of graphite/binder resin of 2/1 to 1/3 produces particularly excellent results.

Spherical resin particles may be incorporated where needed in the coating layer.

Figure 4:
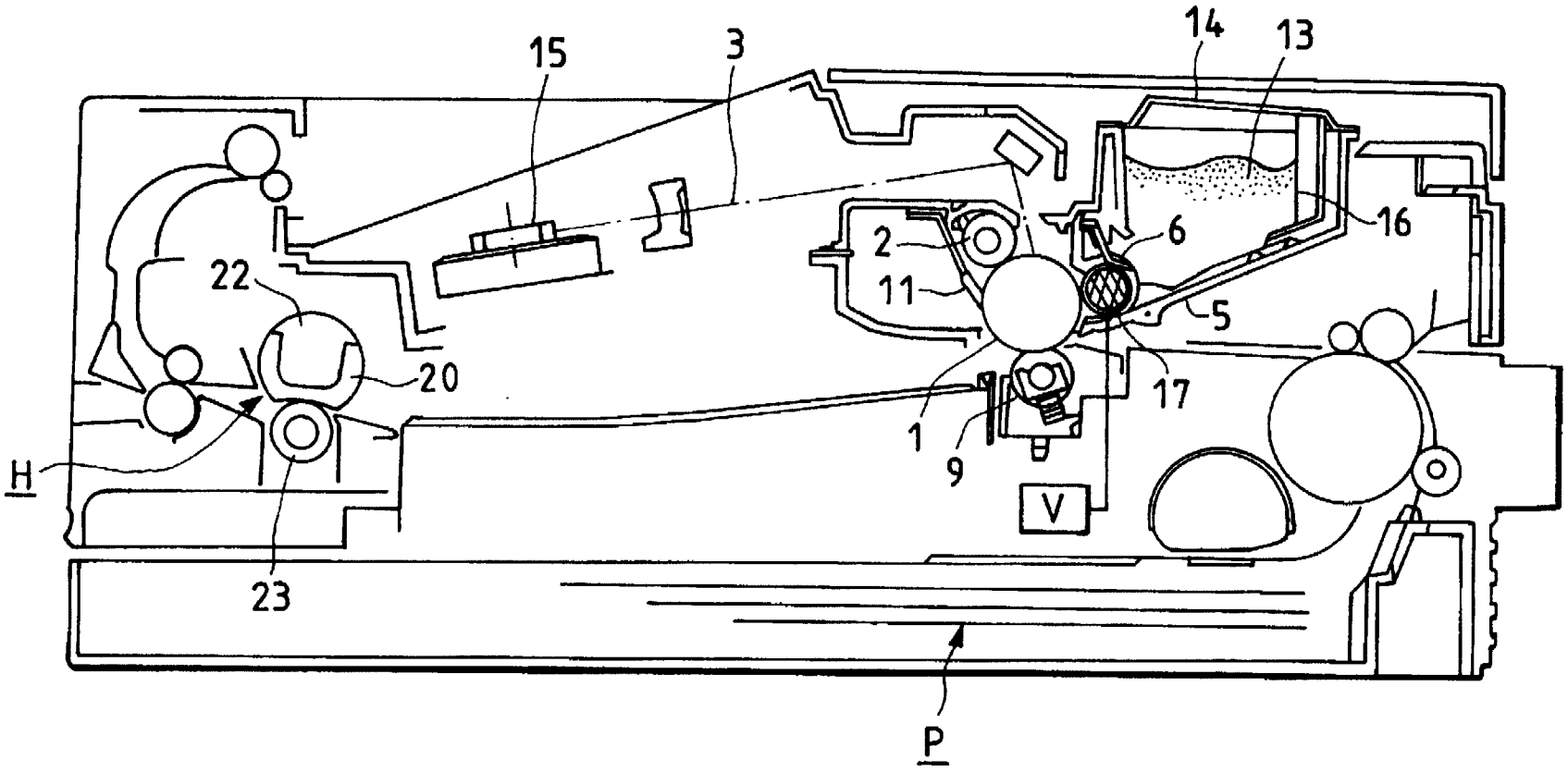
FIG. 4 is a schematic view explanatory of another preferred form of apparatus used to practice the method of the invention.
Figure 5:
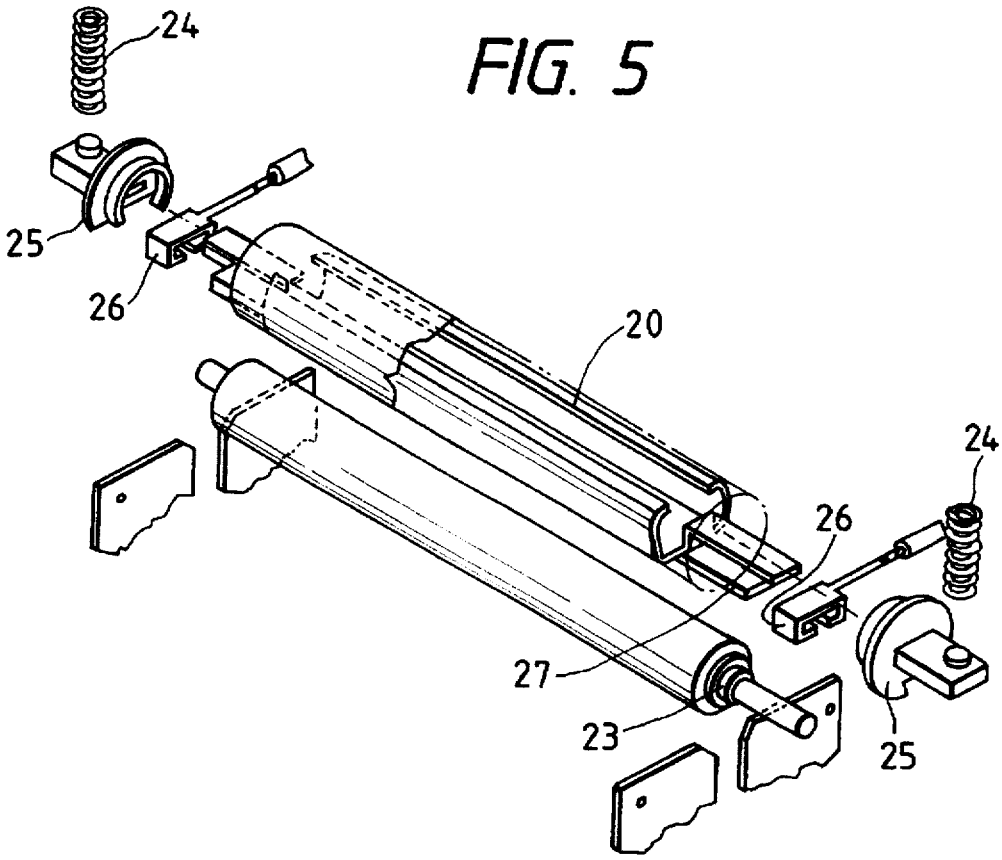
FIG. 5 is an exploded perspective view showing the important parts of a fixing device of the apparatus illustrated in FIG. 4.
Figure 6:
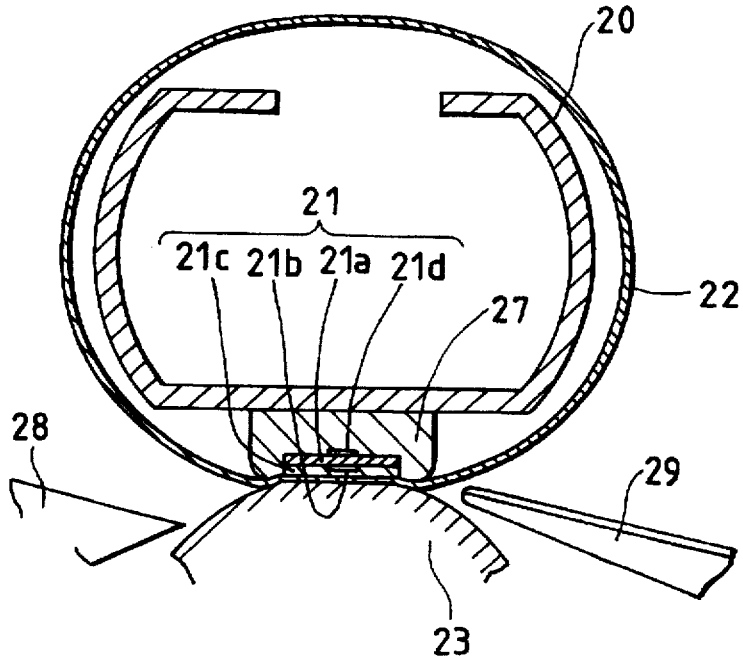
FIG. 6 is an enlarged cross-sectional view of the other important parts of the fixing device of the apparatus illustrated in FIG. 4, a film being shown in a condition not actuated.

The parts of apparatus shown in FIGS. 4 to 6 will then be described.

In these drawings, designated at 1 is an electrostatic image carrying member or a photosensitive drum, at 2 is an electrifying member or an electrifying roller, at 14 is a process cartridge, at 11 is cleaning means, at 15 is light-exposing means, at 16 is a developer container, at 5 is a developing sleeve, at 17 is magnetic field-generating means, at 6 is an elastic member for restricting the layer thickness, at 9 is transferring means or a transferring roll, at 20 is a stay, at 21*a* is a heater substrate, at 21*b* is a thermal generator, at 21*c* is a surface protective layer, at 21*d* is a temperature detector element, at 22 is a fixing film, at 23 is a pressing roll, at 24 is a coiled spring, at 25 is a flange for restricting a film end, at 26 is an electricity supplying connector, at 27 is an electricity disconnetor, at 28 is an inlet guide and at 29 is an exit guide or a separating guide.

A laser beam printer shown in FIG. 4 can be used in the following manner.

The OPC photosensitive drum 1 of 24 mm in diameter is allowed to rotate in the direction indicated by the arrow and is uniformly electrified by the electrifying roll 2 such that a dark potential (Vd) stands at −600 V. An imaging portion is then light-exposed by the light-exposing means 15 to form an electrostatic image of −150 V in light potential. With a space of 300 μm set between the photosensitive drum 1 and the developer layer on the developing sleeve 5 (the magnet 17 contained) to be in not touching condition, the imaging area is developed with a negative toner applying an alternate bias (f=1,800 Hz, Vpp=1,200 V) and also a direct bias ($V_{dc}$=400 V) by bias-applying means V so that a toner image is formed on the photosensitive drum 1. The resulting toner image is transferred on a transfer material P by the transferring roll 9, whereas part of the toner having remained on the photosensitive drum 1 is cleaned by the cleaning plate 11. The transfer material P separated from the photosensitive drum 1 is subjected to fixing treatment with heat by heat fixing means H to fix the toner image on the transfer material. The above process steps are repeated for image formation. For instance, the surface temperature of the temperature detecting element 21*d* of the thermal generator 21 in the heat fixing means H is set at 130° C., the total pressure between the thermal generator 21 and the pressing roll 23 at 6 kg and the nip between the pressing roll 23 and the fixing film 22 at 3 mm. For the fixing film 22, a thermally resistant polyimide film of 60 μm in thickness is used. The fixing film is provided on its surface in contact with the transfer material, with a releasing layer of a low resistivity formed of electrically conductive material-containing PTEP.

Figure 7:
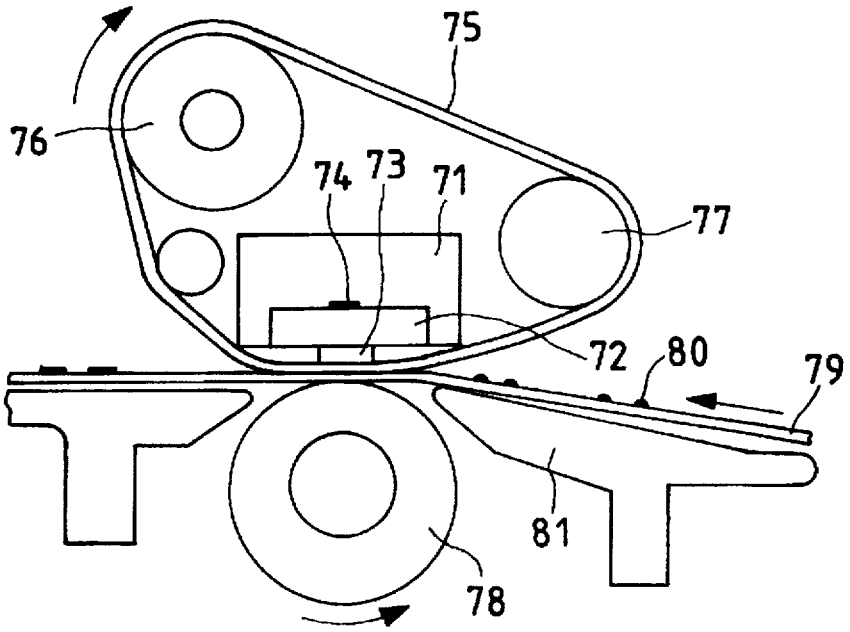
FIG. 7 is a schematic view of another preferred form of fixing device.

In FIG. 7, another preferred form of the heat- and pressure-applying fixing apparatus is schematically shown.

Designated at 71 a linear thermal generator of a low heat volume firmly attached to the apparatus. For example, it may be composed of an alumina substrate 72 of 1.0 mm in thickness, 10 mm in width and 240 mm in length and a resistor material 73 applied thereon in a width of 1.0 mm and structured to be energized from both lengthwise ends thereof. Electrical conduction is controlled by a temperature detector element 74 in the form a pulse-like wave at a frequency of 20 msec and at DC 100 V, whereby a pulse is varied in its width so as to give a desired temperature and a desired quantity of energy emission. The pulse width is substantially from 0.5 to 5 msec.

The fixing film 75 is rotated, in the direction indicated by the arrow, in contact with the thermal generator 71 controlled in its energy and temperature. An example of this fixing film is a thermally resistant, endless film such as polyimide, polyether imide or PES of 20 μm in thickness which is provided at least on its surface in contact with an image with a releasing layer formed in a thickness of 10 μm, the layer being formed of an electrically conductive agent-containing fluorine resin such as PTPE or PES. The overall thickness is generally less than 100 μm, preferably below 40 μm. The fixing film is actuated by a driving roller 76 and a driven roller 77 and in tensioned condition in the direction indicated by the arrow without wrinkles involved.

Reference numeral 78 denotes a pressing roll having a highly releasing, elastic layer of, for example, a silicone rubber. This roll is rotated in contact with the film, while it is pressing the thermal generator at a total pressure of 4 to 20 kg via that film. Unfixed toner image 80 on a transfer material 79 is guided by an inlet guide 81 to a fixing part where the toner image is fixed.

Figure 2:
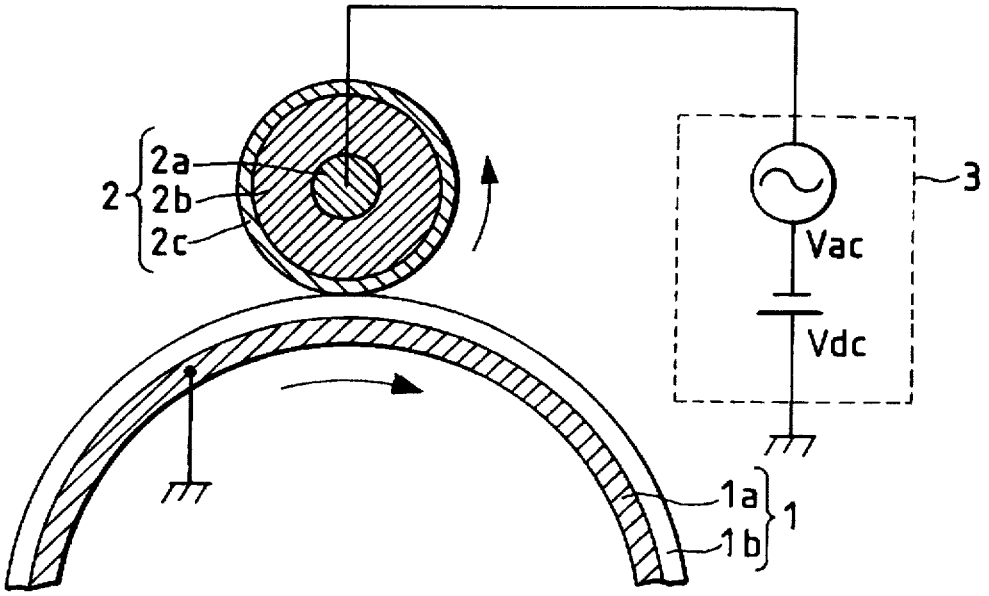
FIG. 2 is a schematic view showing a preferred embodiment of a contact-type electrifying step.

Turning now to FIG. 2, contact electrification will be described below.

As shown in FIG. 2, the electrifying roller 2 is rotated as driven by and in contact with the photosensitive drum 1. By applying to the electrifying roller 2 a voltage ($V_{ac}$+$V_{dc}$) resulting from superposition of an alternate voltage $V_{ac}$ on a direct voltage $V_{dc}$, the photosensitive drum can be uniformly electrified.

The electrifying roller 2 should maintain its electrical conductivity. For this, an electrifying roller is employed which is provided around its metallic core with an electrically conductive material composed of an elastic rubber such as EPDM or NBR and carbon black dispersed therein.

The contact-electrifying means allows for reduced generation of ozone as compared with a conventional corona-electrifying device. The contact-electrifying means, however, is pressed against the photosensitive drum, and the toner is prone to adhere to the surface of the drum, thus causing filming. To solve this problem, the invention contemplates the addition of a particulate silica A and a particulate silica B to the developer.

The transferring step using a transfer roller means will then be described with reference to FIG. 3.

Figure 3:
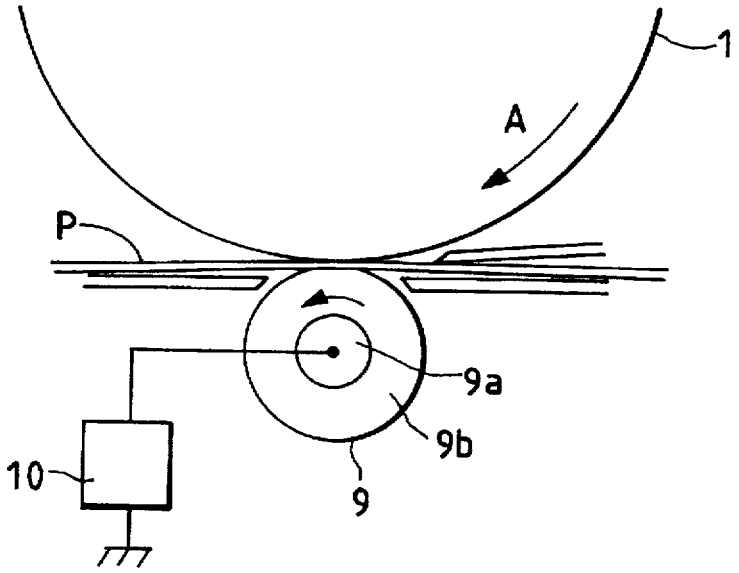
FIG. 3 is a schematic view showing a preferred embodiment of a transferring step.

Transferring apparatus useful in the invention is a transfer roller illustrated in FIG. 3 or a bias-applied transfer belt. FIG. 3 shows a typical image forming apparatus of this type with the important parts schematically cross-sectionally depicted. The illustrated apparatus is constructed with a cylindrical photosensitive drum 1 rotatable in the arrow direction, and a transfer roller 9 located in contact with the drum 1.

The transfer roller 9 has a metallic core 9*a* and an electrically conductive, elastic layer 9*b*. The layer 9*b* is formed of an elastic material such as a polyurethane resin or EPDM of $10^8$ to $10^{10}$ Ω·cm in volume resistivity, which elastic material contains an electrically conductive substance such as carbon black. The metallic core 9*a* is bias-applied by a constant voltage power supply 10. Bias conditions are from 0.1 to 50 μA in electric current and from 100 to 5,000 V, preferably from 500 to 4,000 V, in voltage (the absolute value).

By the use of the transfer roller or belt, ozone generation can be reduced in a greater extent than the corona-transferring apparatus. However, filming due to toner adherence and transfer void of the toner image tend to take place. The invention prevents filming and transfer void by incorporating the specified particulate silicas A and B.

EXAMPLES

The following examples are given to explain the present invention in greater detail. These examples are illustrative, but not restrictive.

Preparation of oil-treated silica (A-1)

A silica fine powder synthesized by the dry method (BET-specific surface area: 200 $m^2/g$) in an amount of 100 parts by weight was previously treated with 10 parts by weight of hexamethyldisilazane and then treated with a hexane solution of 10 parts by weight of dimethylsilicone oil (100 cSt). Heating was done with a temperature rise from room temperature to about 260° C., thereby providing an oil-treated silica (A-1) having an average particle size of 0.02 μm. This silica showed strongly negative frictional electrification in relation to iron particles.

Preparation of oil-treated silica (B-1)

40 Parts by weight of a silica fine powder(BET-specific surface area: 110 $m^2/g$) synthesized by the wet method was treated with 60 parts by weight of dimethylsilicone oil (12000 cst) to thereby obtain an oil-treated silica (B-1). This silica showed strongly negative frictional electrification in relation to iron particles. The average particle size of the silica (B-1) was about 8 μm.

Preparation of oil-treated silicas (A-2) to (A-4)

Silicas (A-2) to (A-4) were obtained in the same manner as in the silica (A-1) with their formulations and properties listed in Table 1.

Preparation of oil-treated silicas (B-2) to (B-6)

Silicas (B-2) to (B-6) were obtained in the same manner as in the silica (B-1) with their formulations and properties listed in Table 1.

Preparation Example 1 of Resin Composition

Synthesis of low-molecular weight polymer (L-1)

300 Parts by weight of xylene was put into a 4-necked flask, and full nitrogen replacement was conducted with stirring, followed by refluxing at elevated temperature. A mixture of 75 parts by weight of styrene, 18 parts by weight of n-butyl acrylate, 7 parts by weight of monobutyl maleate and 2 parts by weight of di-tert-butyl peroxide was added dropwise to the refluxing system over 4 hours, followed by polymerization for 2 hours, thereby obtaining a solution of a low-molecular weight polymer (L-1).

Part of the resulting polymer solution was sampled and dried in vacuo to provide a low-molecular weight polymer (L-1). Measurement by GPC and of glass transition temperature (Tg) showed a weight-average molecular weight (Mw) of 9,600, a number-average molecular weight (Mn) of 6,000, a peak molecular weight (PMw) of 8,500, a Tg of 62° C. and an acid value of 25 mg/KOH/g. The rate of polymer conversion was 97%.

Synthesis of high-molecular weight polymer (H-1)

Into a 4-necked flask were put 180 parts by weight of degassed water and 20 parts by weight of an aqueous solution of 2% by weight of polyvinyl alcohol, and then a solution of 70 parts by weight of styrene, 25 parts by weight of n-butyl acrylate, 5 parts by weight of monobutyl maleate, 0.005 part by weight of divinylbenzene and 0.1 part by weight of 2,2-bis(4,4-di-tert-butylperoxycyclohexyl) propane (10-hour half-life temperature: 92° C.). Stirring was done to prepare a suspension.

After full replacement of the interior the flask with nitrogen gas, polymerization was started at 85° C. The reaction was maintained at the same temperature for 24 hours and then incorporated further with 0.1 part by weight of benzyl peroxide (10-hour half-life temperature: 72° C.). Polymerization was continued for another 12 hours, followed by filtration, washing with water and drying of the resulting high-molecular weight polymer (H-1). Analyses revealed that the polymer was 5% by weight in THF insoluble, $180\times10^4$ in Mw, $120\times10^4$ in PMw, 62° C. in Tg and 6 (mgKOH/g) in acid value.

Preparation of binder

Into a 4-necked flask were put 100 parts by weight of xylene, 25 parts by weight of the high-molecular weight polymer (H-1) and 4 parts by weight of a low molecular weight polypropylene (Mw: 6,000). The mixture was predissolved by refluxing with stirring at elevated temperature. Refluxing was continued for 12 hours to thereby obtain a preliminary uniform solution (Y-1) of the high-molecular weight polymer (H-1) and low molecular weight polypropylene.

The preliminary solution was sampled and dried in vacuo to provide a solid matter which was determined to be 61° C. in Tg.

300 Parts by weight of the solution of the low-molecular weight polymer (L-1) obtained above was put into another reactor and subjected to refluxing.

The solution (Y-1) of the high-molecular weight polymer and the solution of the low-molecular weight polymer (L-1) were mixed under refluxing, then the organic solvent was removed. The resulting resin was cooled, solidified and pulverized to obtain a resin composition I for use as a toner.

The resin composition I was analyzed and determined to be $110\times10^4$ in PMw, 9.2 in the area ratio of resin above $100\times10^4$ in molecular weight distribution of the resin determined by GPC, 62.5° C. in Tg and 2.1% by weight in THF insoluble matter in resin composition other than low molecular weight polypropylene.

Preparation Examples 2 to 4 and 6 of Resin Compositions

As was in Preparation Example 1, monobutyl maleate, styrene, n-butyl acrylate and the polymerization initiator were used in their varied amounts, whereupon low-molecular weight polymers (L-2) to (L-4) were prepared. Blending of the high-molecular weight polymer in its given amounts with each of the polymers (L-2) to (L-4) provided resin compositions II to IV and VI. The molecular weight distributions and other physical properties of these resin compositions are listed in Table 1.

Preparation Examples 5 and 7 of Resin Compositions

The procedure for Preparation Example 1 was followed except that styrene and n-butyl acrylate only were used as monomers. A low-molecular weight polymer (L-5) and a high-molecular weight polymer (H-2) were obtained which were then blended in their predetermined amounts to provide resin compositions V and VII. The molecular weight distributions and physical properties are tabulated in Table 2.

EXAMPLE 1

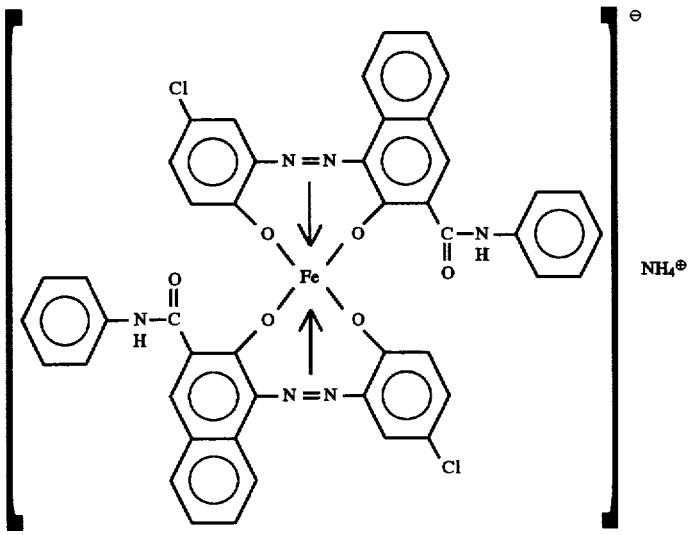

Melt kneading of the mixture of above components was carried out with a biaxial extruder heated at 140° C., and the resulting mixture was cooled coarsely crushed using a hammer mill and subsequently pulverized using a jet mill. Classification of the pulverizate was conducted with an air classifier of a stationary wall type, then the classified fine particles were further classified by a multi-dividing classifier taking advantage of the Coanda effect (an Elbow Jet classifier; Nittetsu Kogyo Co.), whereby ultrafine particles and coarse particles were simultaneously removed with great precision. This produced a magnetic toner of negative charging having a weight-average particle size of 6.5 μm. The toner contained 22% by number of particles below 4.0 μm in diameter in the particle-number distribution and 0.5% by volume of particles above 10 μm in diameter in the particle-volume distribution. The toner particles thus obtained were mixed with particulate silicas A and B shown in Table 3, thereby producing negatively chargeable, magnetic one-component developers.

EXAMPLES 2 TO 10 AND COMPARATIVE EXAMPLES 1 TO 7

As was in Example 1, magnetic one-component developers were prepared with use of toners B to Q shown in Tables 3 and 4. The particle distributions of these developers were virtually identical to that of Example 1.

TABLE 1

| Oil-treated Silica | Oil | Viscosity (cSt) | Amount of Oil (wt %) | Average Particle Size (μm) | Si Atomic ratio* | Matrix Silica Coupling | Specific Surface Area of Silica BET($m^2/g$) | True Specific Gravity of Silica ρ($g/cm^3$) | P.S. ≦1.00 μm (%) | P.S. ≧100 μm (%) |
|---|---|---|---|---|---|---|---|---|---|---|
| A-1 | dimethyl silicone oil | 100 | 9 | 0.020 | — | hexamethyl-disilazane | 135 | 2.1 | — | — |
| A-2 | same | 500 | 20 | 0.012 | — | same | 250 | 2.0 | — | — |
| A-3 | same | 10 | 10 | 0.08 | — | same | 24 | 2.1 | — | — |
| A-4 | same | 1000 | 10 | 0.020 | — | same | 140 | 2.1 | — | — |
| B-1 | dimethyl silicone oil | 12500 | 60 | 8 | 4.5 | — | 0.5 | 1.4 | 1 | 1 |
| B-2 | same | 5000 | 32 | 1 | 2.0 | — | 3.5 | 1.7 | 40 | 0 |
| B-3 | same | 60000 | 65 | 40 | 7.5 | — | 0.2 | 1.3 | 0 | 7 |
| B-4 (Com. Ex.) | same | 60000 | 67 | 46 | 7.6 | — | 0.15 | 1.3 | 0 | 15 |
| B-5 (Com. Ex.) | same | 5000 | 30 | 0.8 | 1.9 | — | 4.2 | 1.7 | 57 | 0 |

*XPS-atomic ratio of Si atoms of silicone oil to Si atoms of matrix silica ($SiO_2$) in oil treated silica B
Com. Ex. → Comparative Example
P.S. → Particle Size

TABLE 2

Physical Properties of Resin Compositions

| | Resin Comp. | Low Molecular Polymer ($M_L$) | | | | | | High Molecular Polymer ($M_H$) | | | | | Composition | |
|---|---|---|---|---|---|---|---|---|---|---|---|---|---|---|
| | | | Mw | PMw | Tg (°C.) | $A_{VL}'$ (mgKOH/g) | $M_L/M_H$ ($W_L/W_H$) | | Mw | PMw | Tg (°C.) | $A_{VL}'$ (mgKOH/g) | Mw≧100×10⁴ GPC area (%) | THF Insolubles (%) |
| Pre. Ex. 1 | I | L-1 | 9600 | 8500 | 62 | 25 | 75/25 | H-1 | $180\times10^4$ | $120\times10^4$ | 62 | 6 | 9.2 | 2.1 |
| Pre. Ex. 2 | II | L-2 | 5000 | 3700 | 64 | 26.3 | 50/50 | H-1 | $180\times10^4$ | $120\times10^4$ | 62 | 6 | 16.4 | 3.5 |
| Pre. Ex. 3 | III | L-3 | 30000 | 28000 | 63.2 | 33.8 | 90/10 | H-1 | $180\times10^4$ | $120\times10^4$ | 62 | 6 | 4.0 | 1.0 |
| Pre. Ex. 4 | IV | L-4 | 9700 | 8500 | 62 | 25 | 75/25 | H-1 | $180\times10^4$ | $120\times10^4$ | 62 | 6 | 9.0 | 2.0 |
| Pre. Ex. 5 | V | L-5 | 9800 | 8600 | 62 | 0 | 75/25 | H-1 | $180\times10^4$ | $120\times10^4$ | 62 | 6 | 9.2 | 2.2 |
| Pre. Ex. 6 | VI | L-6 | 9700 | 8500 | 62 | 41.2 | 75/25 | H-1 | $180\times10^4$ | $120\times10^4$ | 62 | 6 | 9.1 | 2.1 |
| Pre. Ex. 7 | VII | L-5 | 9800 | 8600 | 62 | 0 | 75/25 | H-2 | $120\times10^4$ | $83\times10^4$ | 61 | 0 | 2.5 | 1.0 |

Resin Comp. → Resin Composition
Pre. Ex. → Preparation Example

TABLE 3

| | TONER No. | GPC-MW Distribution Low Mol Peak (LMp) | High Mol Peak (HMp) | M ≧ 100 × 10⁴ Area (%) | THF Insoluble (wt %) | Resin Composition | Oil-treated Silica A/ Amount (wt/%) | Oil-treated Silica B/ Amount (wt/%) |
|---|---|---|---|---|---|---|---|---|
| Example 1 | A | 8,100 | $67\times10^4$ | 5.1 | 0.9 | I | A-1/1.2 | B-1/0.1 |
| Example 2 | B | 8,100 | $67\times10^4$ | 5.1 | 0.9 | I | A-2/0.8 | B-3/0.05 |
| Example 3 | C | 8,100 | $67\times10^4$ | 5.1 | 0.9 | I | A-3/2.2 | B-1/0.2 |
| Example 4 | D | 8,100 | $67\times10^4$ | 5.1 | 0.9 | I | A-4/1.4 | B-2/0.4 |
| Example 5 | E | 3,600 | $62\times10^4$ | 9.2 | 1.4 | II | A-1/1.2 | B-1/0.1 |
| Example 6 | F | 26,000 | $68\times10^4$ | 3.0 | 0.4 | III | A-1/1.2 | B-1/0.1 |
| Example 7 | G | 8,200 | $67\times10^4$ | 5.0 | 0.9 | IV | A-1/1.2 | B-1/0.1 |
| Example 8 | H | 8,200 | $67\times10^4$ | 5.1 | 0.3 | V | A-1/1.2 | B-1/0.1 |
| Example 9 | I | 8,200 | $67\times10^4$ | 5.0 | 0.9 | VI | A-1/1.2 | B-1/0.1 |
| Example 10 | J | 8,100 | $42\times10^4$ | 1.8 | 0.9 | VII | A-1/1.2 | B-1/0.1 |
| Com. Ex. 1 | K | 8,100 | $67\times10^4$ | 5.1 | 0.9 | VII | A-3/2.2 | B-2/0.4 |
| Com. Ex. 2 | L | 8,100 | $67\times10^4$ | 5.1 | 0.9 | VII | A-2/0.8 | B-2/0.2 |
| Com. Ex. 3 | M | 8,100 | $67\times10^4$ | 5.1 | 0.9 | VII | A-1/1.2 | B-1/0.5 |
| Com. Ex. 4 | N | 8,100 | $67\times10^4$ | 5.1 | 0.9 | VII | A-1/1.3 | — |
| Com. Ex. 5 | O | 8,100 | $67\times10^4$ | 5.1 | 0.9 | VII | — | B-1/1.2 |
| Com. Ex. 6 | P | 8,100 | $67\times10^4$ | 5.1 | 0.9 | VII | A-2/0.8 | B-4/0.05 |
| Com. Ex. 7 | Q | 8,100 | $67\times10^4$ | 5.1 | 0.9 | VII | A-4/1.4 | B-5/0.4 |

TABLE 4

Acid Values of Low- and High-Molecular Polymers

| Toner No. | $A_{VL}$ | $A_{VH}$ | $A_{VL}-A_{VH}$ | $A_{VL}\times\frac{W_L}{W_L+W_H}$ | $A_{VH}\times\frac{W_H}{W_L+W_H}$ | $\frac{1}{W_L+W_H}(A_{VL}W_L+A_{VH}W_H)$ |
|---|---|---|---|---|---|---|
| A | 23 | 7 | 16 | 17.25 | 1.75 | 19 |
| E | 21 | 7 | 14 | 10.5 | 3.5 | 14 |
| F | 32.5 | 7 | 25.5 | 29.25 | 0.7 | 29.95 |
| G | 16 | 7 | 9 | 12 | 1.75 | 13.75 |
| H | 0.7 | 7 | −6.3 | 5.2 | 1.75 | 2.27 |
| I | 40 | 7 | 33 | 30 | 1.75 | 31.75 |
| J | 0 | 0 | 0 | 0 | 0 | 0 |
| B | 23 | 7 | 16 | 17.25 | 1.75 | 19 |
| C | 23 | 7 | 16 | 17.25 | 1.75 | 19 |
| D | 23 | 7 | 16 | 17.25 | 1.75 | 19 |
| K | 0 | 0 | 0 | 0 | 0 | 0 |
| L | 0 | 0 | 0 | 0 | 0 | 0 |
| M | 0 | 0 | 0 | 0 | 0 | 0 |
| N | 0 | 0 | 0 | 0 | 0 | 0 |

TABLE 4-continued

Acid Values of Low- and High-Molecular Polymers

| Toner No. | $A_{VL}$ | $A_{VH}$ | $A_{VL} - A_{VH}$ | $A_{VL} \times \frac{W_L}{W_L + W_H}$ | $A_{VH} \times \frac{W_H}{W_L + W_H}$ | $\frac{1}{W_L + W_H}(A_{VL}W_L + A_{VH}W_H)$ |
|---|---|---|---|---|---|---|
| O | 0 | 0 | 0 | 0 | 0 | 0 |
| P | 0 | 0 | 0 | 0 | 0 | 0 |
| Q | 0 | 0 | 0 | 0 | 0 | 0 |

EXAMPLES 11 TO 20 AND COMPARATIVE EXAMPLES 8 TO 14

By the use of the magnetic one-component developers (toners A to Q) prepared in Examples 1 to 10 and in Comparative Examples 1 to 7, image forming tests were performed on a laser beam printer, LBP-209GII (product of Canon Inc.) with an OPC photosensitive drum, which was remodeled to operate at from 16 sheets/minute to 28 sheets/minute.

In the remodeled printer, a charging roller applied with a direct and an alternating bias was allowed to press against the OPC photosensitive drum with a tangential pressure of 48 g/cm (37 g/cm prior to remolding). The developing sleeve of the developing apparatus used here was such having a cylindrical aluminum provided there around with a phenol resin layer. Contained in this layer was graphite having dispersed therein carbon black, and the cylindrical aluminum had a magnet accommodated. With a magnetic one-component developer of negative triboelectricity coated was the developing sleeve with use of an elastic coating blade. A digital latent image (an electrostatic image) formed on the OPC photosensitive drum was developed in a reverse developing system. The toner image was transferred with a direct bias-applied transfer roller to the transfer paper (plain paper). A transfer roller was so disposed as to press the OPC photosensitive drum in a tangential pressure of 43 g/cm. The toner image on the transfer paper was fixed by heat- and pressure-applying fixing means.

Under the conditions set above, printing was done with 8,000 sheets in a print mode of 28 sheets/minute and in a low temperature-low humidity environment (15° C., 10% RH) and in a high temperature and high humidity environment (30° C., 80% RH).

Performance evaluation was made on the following items.

(1) image density

This was evaluated with the image density on plain copying paper (75 g/m$^2$) after printing of 10,000 sheets. The relative density of an original white background of 0.00 to a printout image was measured with a Macbeth reflection densitometer (Macbeth Co.).

(2) Fogging

Figging was calculated from comparison of the whiteness (%) of a transfer paper measured by a reflecmeter (Tokyo Denshoku Co.) before use, and the whiteness (%) of the printed blank image. Testing was conducted in a low temperature and low humidity environment (15° C., 10% RH) with a print mode of 2 sheets/20 seconds.

(3) image quality (dot reproducibility)

Figure 8:
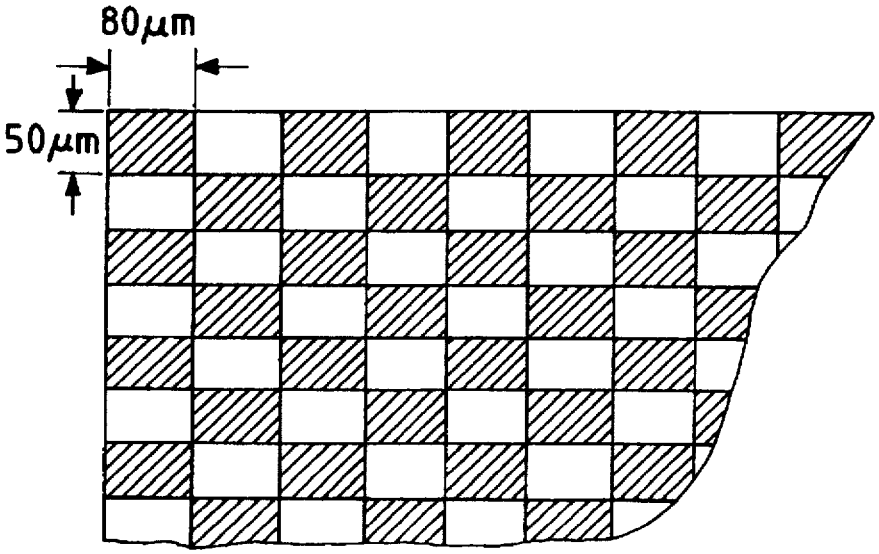
FIG. 8 is a view explanatory of a checker for examining the developing characteristics of the developer according to the invention.

Dot reproducibility was determined by printing a checker pattern shown in FIG. 8.

⊙: excellent (2 voids/100 pieces or less)

○: good (3 to 5 voids/100 pieces)

Δ: practical (6 to 10 voids/100 pieces)

x: poor (11 voids/100 pieces or more)

(4) prevention of toner adherence to photosensitive drum surface and to charging roller surface ⊙: excellent (free)

○: good (slightly scarred, image not affected)

Δ: practical (adhered and scarred, image slightly affected)

x: poor (much adhered, stripy image deffect)

(5) transfer rate

The rate of transferring a toner image from the OPC photosensitive drum to a transfer paper sheet was measured, as indicated below, at the initial and the final stages of 8,000 sheets printing in a low temperature and low humidity environment.

A toner image (image density: about 1.3) formed on the OPC photosensitive drum was collected with an adhesive tape. The image density on the tape was measured by a Macbeth densitometer or a color reflection densitometer (X-RITE 404A; X-Rite Co.). A toner image corresponding to the above image was again formed on that drum and transferred to a transfer sheet, and the toner image on the transfer sheet collected with a transparent adhesive tape. The image density was likewise measured. The rate of transfer was counted from the equation below.

rate of transfer (%) = (image density of toner image collected from transfer sheet)/(image density of toner image collected from *OPC* photosensitive drum) × 100

(6) environmental stability

Only a developing device was exposed to a high temperature and high humidity environment (35° C., 85% RH), where the developing sleeve was allowed to rotate at a peripheral speed of 150 mm/second. The amount of the triboelectricity of the toner on the sleeve was measured at an initial stage, after 3 minutes, after 10 hours, after standing (5 days) and with additional 3 minutes after the standing.

As regards the triboelectric value on the developing sleeve determined by the aspiration method, a measuring container provided with a cylindrical filter paper is used in place of a 500-mesh screen. Attached to the container is a metallic aspiration inlet conforming to the shape of the sleeve surface, instead of a metallic cover. The pressure of aspiration can be adjusted to wholly aspirate a toner layer on the surface of the sleeve immediately after formation of an image (preferably within 5 minutes). The weight of the toner thus aspirated is taken as M (kg) with which calculation is made from the equation below.

$$Qm = CV/M$$

(7) prevention of toner adherence to developing sleeve

Toner adherence to the surface of the developing sleeve after the durability test was evaluated with the following criteria with the results shown in Table 5.

◎: excellent (nil)

○: good (substantially nil)

Δ: practical (adhered, image not affected)

x: poor (much adhered, image disordered)

TABLE 5

Evaluation Results

| | Toner | Fog Prevention (both sides) L/L | Smudge Prevention of Electrifying Roller L/L | Smudge Prevention Of OPC Drum L/L | Smudge Prevention Of OPC Drum H/H | Toner Electrification Stability (H/H) (mC/kg) Initial | After 3 minutes | After 5 hrs | After 5-day standing | After 3 min after-standing | Dot Reproducibility H/H | Adhesion Prevention of Toner on Sleeve Surface | Transfer Ratio (%) Initial | Transfer Ratio (%) Later |
|---|---|---|---|---|---|---|---|---|---|---|---|---|---|---|
| Example 11 | A | 1.8% | ◎ | ◎ | ◎ | −8.5 | −8.7 | −8.7 | −8.5 | −8.7 | ◎ | ◎ | 96 | 94 |
| Example 12 | B | 2.0% | ◎ | ○ | ◎ | −8.2 | −8.4 | −8.6 | −8.3 | −8.3 | ◎ | ◎ | 96 | 93 |
| Example 13 | C | 2.3% | ○ | ○ | ○ | −8.1 | −8.5 | −8.0 | −7.9 | −8.1 | Δ | Δ | 93 | 90 |
| Example 14 | D | 2.0% | ○ | ○ | ○ | −8.1 | −8.3 | −8.4 | −8.0 | −8.1 | ○ | ○ | 96 | 92 |
| Example 15 | E | 2.3% | ◎ | ◎ | ◎ | −8.5 | −8.6 | −8.7 | −8.5 | −8.7 | ○ | ◎ | 96 | 92 |
| Example 16 | F | 2.4% | ◎ | ◎ | ◎ | −8.1 | −8.3 | −8.7 | −8.1 | −8.3 | Δ | ◎ | 96 | 91 |
| Example 17 | G | 2.4% | ◎ | ○ | ○ | −8.2 | −8.4 | −8.7 | −8.1 | −8.2 | Δ | ◎ | 96 | 91 |
| Example 18 | H | 2.7% | ◎ | ◎ | ○ | −7.9 | −8.3 | −8.9 | −8.0 | −8.2 | Δ | ○ | 94 | 91 |
| Example 19 | I | 2.6% | ◎ | ◎ | ◎ | −7.9 | −8.5 | −9.0 | −8.0 | −8.5 | Δ | ◎ | 94 | 91 |
| Example 20 | J | 2.6% | ◎ | ◎ | ○ | −7.9 | −8.1 | −8.8 | −7.9 | −8.0 | Δ | ○ | 93 | 90 |
| Com. Ex. 8 | K | 3.2% | Δ | Δ | Δ | −7.9 | −8.1 | −8.7 | −7.8 | −7.8 | Δ | Δ | 93 | 88 |
| Com. Ex. 9 | L | 3.7% | ○ | ○ | ○ | −7.8 | −8.1 | −8.7 | −7.8 | −8.0 | Δ | ○ | 93 | 89 |
| Com. Ex. 10 | M | 3.0% | ○ | ○ | ○ | −7.9 | −8.0 | −8.8 | −7.8 | −8.1 | | Δ | 96 | 89 |
| Com. Ex. 11 | N | 2.5% | Δ | | Δ | −7.9 | −8.0 | −8.8 | −7.8 | −8.0 | ◎ | ○ | 93 | 86 |
| Com. Ex. 12 | O | 5.0% | | | | −7.0 | −7.1 | −6.8 | −5.0 | −5.1 | | | 80 | 72 |
| Com. Ex. 13 | P | 3.4% | ○ | ○ | Δ | −7.8 | −8.1 | −8.9 | −8.2 | −8.4 | Δ | ○ | 96 | 90 |
| Com. Ex. 14 | Q | 3.0% | Δ | Δ | Δ | −7.9 | −8.3 | −8.7 | −7.8 | −8.1 | Δ | ○ | 93 | 85 |

Com. Ex. → Comparative Example

EXAMPLE 21

The procedure of Example 1 was followed except for the use of a developing sleeve prepared as indicated below, whereby print testing was effected with the results shown in Table 6.

graphite: 100 parts by weight (Showa Denko Co.; UFG-10; graphitization 100%; lengthwise diameter 5 μm; thickness 0.5 μm or less)

resol type phenol resin: 100 parts by weight spherical polyethylene particles: 4 parts by weight (positively chargeable, average particle size 2 μm)

The above coating materials were mixed with 76 parts by weight of butyl alcohol, and the mixture was dispersed for 10 hours in a ball mill containing, as media particles, balls of 20 μm in diameter. Subsequently, the balls were removed by a 64-mesh sieve to obtain a mother liquid (solid content: 24% by weight).

To the mother liquid was added 20 parts by weight of butyl alcohol to give a coating liquid (solid content: 20% by weight). This coating liquid was applied by dipping on to the outer surface of a 20 mm-diameter aluminum cylinder in a thickness of 10 μm. The coated cylinder was solidified at 150° C./30 minutes in a hot-air drying furnace, after which a developing sleeve was provided.

The surface roughness (Ra) of the coating was 2.5 μm.

COMPARATIVE EXAMPLE 15

The procedure of Example 21 was followed except for the use of the toner K. Printing was effected with the results listed in Table 6.

TABLE 6

| | Toner No. | Dot Reproducibility | Dot Scattering Prevention | Toner Electrification (mC/kg) Initial | After 3 min | After 5 hr | After standing | After 3 min after-standing | Toner Coat on Sleeve (mg/cm²) |
|---|---|---|---|---|---|---|---|---|---|
| Example 21 | A | ◎ | ◎ | −8.5 | −8.7 | −8.7 | −8.5 | −8.7 | 1.75 |
| Com. Ex. 15 | K | Δ | | −7.7 | −8.1 | −8.6 | −7.7 | −7.7 | 1.80 |

Com. Ex. → Comparative Example

EXAMPLE 22

The procedure of Example 11 was followed except that a laser beam printer (LBP-A308; Canon Inc.) was used and the toner image on the transfer paper was fixed by heat- and pressure-applying means shown in FIG. 7. Printing was conducted with the results shown in Table 7.

An electrostatic image was formed by a laser light with a primary charging of −600 V. An alternating bias (f=1,800 Hz, Vpp=1,600 V) and a direct bias (VCD=−500 V) were applied to the developing sleeve. A space (300 μm) was set at between the OPC photosensitive drum and the toner layer on that sleeve containing magnets. The electrostatic image was developed by a reverse developing system to thereby form a toner image.

In the heat fixing apparatus of FIG. 7, the surface temperature of each of the thermal generator 71 and the temperature detecting element 74 was set at 150° C., the overall pressure between the thermal generator 71 and the pressing roller 78 at 6 kg, the nip between the pressing roller 78 and the film 75 at 3 mm and the speed of revolution of the pressing roller 78 at 38 mm/second.

As a thermally resistant sheet 75, was used a 50-μm thick polyimide film having a releasing layer of low resistivity, such releasable layer being composed of PTPE having dispersed therein an electrically conductive material and being disposed for contact with the transfer paper 79.

Under the above conditions, a continuous printing test was effected with 6,000 sheets at a printing speed of 8 sheets (A4, widthwise supply)/minutes by a reverse developing system and in a normal temperature and humidity environment (25° C., 60% RH). The resultant images were evaluated in respect of the following items. Checking was also made as to the surface of the fixing film to evbaluate the durability.

[A] evaluation of printout image (1) anti-offset property

This property was evaluated by the frequency of image smudge after printing of 6,000 sheets with a sample image of an about 5% image area.

⊙: excellent (nil)

○: good (substantially nil)

Δ: fair x: poor (2) image density

This property was evaluated by the image density on plain copying paper (75 g/m$^2$) after printing of 6,000 sheets. The relative density of a printout image to the density of copied white image of 0.0 in density was measured with a Macbeth reflection densitometer (Macbeth Co.).

⊙: excellent above 1.40

○: good 1.40 to 1.35

Δ: fair 1.35 to 1.00 x: poor 1.00 of less (2) image quality

Naked inspection was made of toner scattering black spots around image and image roughness.

⊙: excellent

○: good

Δ: fair x: poor

[B] evaluation of durability of fixing film (1) surface

Naked inspection was made of scar or abrasion on the fixing film.

⊙: excellent (nil)

○: good (substantially nil)

Δ: fair x: poor (2) adherence of residual toner

Naked inspection was made of adherence of residual toner on the fixing film after printout.

⊙: excellent (nil)

○: good (substantially nil)

Δ: fair x: poor

COMPARATIVE EXAMPLES 16 AND 17

The procedure of Example 21 was followed except that the toners K and L were used. Print testing was made with the results shown in Table 7.

TABLE 7

| | | Printed Out Image | | | Fixing File Durability | |
|---|---|---|---|---|---|---|
| | Toner No. | Offset Resistance | Image Density | Image Quality | Surface State | Residual Toner Adhesion |
| Example 21 | A | ⊙ | ⊙ | ⊙ | ⊙ | ⊙ |
| Com. Ex. 16 | K | Δ | Δ | Δ | Δ | Δ |
| Com. Ex. 17 | L | ○ | X | X | Δ | Δ |

Com. Ex. → Comparative Example

What is claimed is:

1. A developer for developing an electrostatic image which comprises a toner comprising a particulate toner, a particulate silica A and a particulate silica B, the toner having a weight-average particle size of not larger than 12.0 μm and a particle-number distribution showing not more than 50% of toner particles not larger than 4.0 μm in particle size and not more than 10% of toner particles not smaller than 10.08 μm in particle size, each of the toner particles being formed of a toner composition comprising at least a polymer component and a charge controlling agent, the particulate silica A being composed of silicone oil-treated silica particles and having an average particle size of not larger than 0.1 μm, the particulate silica B being composed of silicone oil-treated silica particles and having an average particle size of 0.5 to 50 μm and a particle-number distribution showing not more than 50% of silica particles not larger than 1.0 μm in particle size and not more than 10% of silica particles not smaller than 100 μm in particle size, the particulate silica A and particulate silica B meeting the following requirements, (a) the average particle size $D_B$ of the particulate silica B is 10 times or more larger than the average particle size $D_A$ of the particulate silica A, (b) the silicone oil amount $W_B$ used to treat the particulate silica B is twice or more larger than the silicone oil amount $W_A$ used to that the particulate silica A, and (c) the particulate silica A is added in an amount 3 times or more larger than the particulate silica B with respect to the toner particles (based on weight).

2. The developer according to claim 1, wherein the silicone oil amount $W_A$ of the particulate silica A is in the range of 1 to 30% by weight based on the weight of the oil-treated silica particles, and the silicone oil amount $W_B$ of the particulate silica B is in the range of 30 to 90% by weight based on the weight of the oil-treated silica particles.

3. The developer according to claim 1 or 2, wherein the amount of the particulate silica A to be added to the toner particles is in the range of 0.3 to 3.0% by weight, and the amount of the particulate silica B to be added to the toner particles is in the range of 0.005 to 0.5% by weight.

4. The developer according to claim 1, wherein the viscosity of silicone oil used to treat the particulate silica B is 10 times or more larger than the viscosity of silicone oil used to treat the particulate silica A.

5. The developer according to claim 1, wherein the particulate silica B meets an atomic ratio of $W_s/W_o$ of 1 to 10 where $W_o$ is the amount of Si atoms induced from the silicone oil, and $W_s$ is the amount of Si atoms present in a matrix particulate silica prior to treatment with the silicone oil.

6. The developer according to claim 1, wherein the polymer component has an acid value of not less than 1 mgKOH/g.

7. The developer according to claim 1, wherein the polymer has a low-molecular weight polymer component and a high-molecular weight polymer component, the low-molecular weight polymer component being in a region of molecular weight less than 50,000, the high-molecular weight polymer component being in a region of molecular weight not less than 50,000, both polymer components meeting the equation $$A_{VL}>A_{VH}$$

where $A_{VL}$ is the acid value of the low-molecular weight polymer component, and $A_{VH}$ is the acid value of the high-molecular weight polymer component.

8. The developer according to claim 7, wherein the polymer is substantially free from THF insolubles, the polymer has a main peak in a region of molecular weight from $3\times10^3$ to $3\times10^4$ and a sub peak or shoulder in a region of molecular weight from $1\times10^5$ to $3\times10^6$, both regions being defined on a chromatogram by GPC of THF solubles of the polymer, the low-molecular weight polymer component has an acid value ($A_{VL}$) of 21 to 35 mgKOH/g, and the high-molecular weight polymer component has an acid value ($A_{VH}$) of 0.5 to 11 mgKOH/g, the difference in acid value being represented by the equation $$10\leqq(A_{VL}-A_{VH})\leqq27.$$

9. The developer according to claim 7, wherein the toner composition has a glass transition temperature (Tg) of 50° to 70° C., $Tg_L$ of the low-molecular weight polymer component and $Tg_H$ of the high-molecular weight polymer component meeting the equation, both polymer components being present in the toner composition, $$Tg_L\geqq Tg_H-5.$$

10. The developer according to claim 7, wherein the toner composition has a Tg of 55° to 65° C., $Tg_L$ of the low-molecular weight polymer component and $Tg_H$ of the high-molecular weight polymer component meeting the equation, both polymer components being present in the toner composition, $$Tg_L\geqq Tg_H.$$

11. The developer according to claim 7, wherein the toner composition meets the equations, $$W_L:W_H=50:50 \text{ to } 90:10$$

$$A_{VL}\times(W_L/(W_L+W_H))\geqq A_{VH}\times(W_H/(W_L+W_H))\times4$$

$$11\leqq(1/(W_L+W_H))(A_{VL}W_L+A_{VH}W_H)\leqq30$$

where $W_L$ is the amount (% by weight) of the low-molecular weight polymer component, $W_H$ is the amount (% by weight) of the high-molecular weight polymer component, $A_{VL}$ is the acid value (mgKOH/g) of the low-molecular weight polymer component, and $A_{VH}$ is the acid value (mgKOH/g) of the high-molecular weight polymer component.

12. The developer according to claim 7, wherein each of the low- and high-molecular weight polymer components has at least one styrene monomer unit of not less than 65% by weight.

13. The developer according to claim 7, wherein the high-molecular weight polymer component is a polymer derived from use of a polyfunctional polymerization initiator.

14. The developer according to claim 7, wherein the high-molecular weight polymer component is a polymer derived from use of a polyfunctional polymerization initiator and a monofunctional polymerization initiator.

15. The developer according to claim 1, wherein the particulate silica A is treated with an organic surface-treating agent before treatment With the silicone oil.

16. The developer according to claim 1, wherein the toner has a weight-average particle size of not larger than 10 μm, and smaller not more than 30% in the number of particles not larger than 4.0 μm and not more than 5% in the number of particles not smaller than 10 μm in the particle-number distribution.

17. The developer according to claim 1, wherein the particulate silica B contains not more than 30% in the number of particles not larger than 1.0 μm and not more than 5% in the number of particles not smaller than 100 μm in the particle-number distribution.

18. The developer according to claim 1, wherein the toner has a weight-average particle size of not larger than 10 μm, and not more than 30% in the number of particles not larger than 4.0 μm and not more than 5% in the number of particles not smaller than 10 μm in the particle-number distribution, and the particulate silica B contains not more than 30% in the number of particles not larger than 1.0 μm and not more than 5% in the number of particles not smaller than 100 μm in the particle-number distribution.

19. The developer according to claim 1, wherein the particulate silicas A and B have the same polarity as the triboelectric property of the toner particles.

20. The developer according to claim 19, wherein the particulate silicas A and B have negative triboelectric characteristics, and the toner particles have negative triboelectrific characteristics.

21. The developer according to claim 20, wherein the toner particles contain as a negative charge controlling agent a compound of the formula,

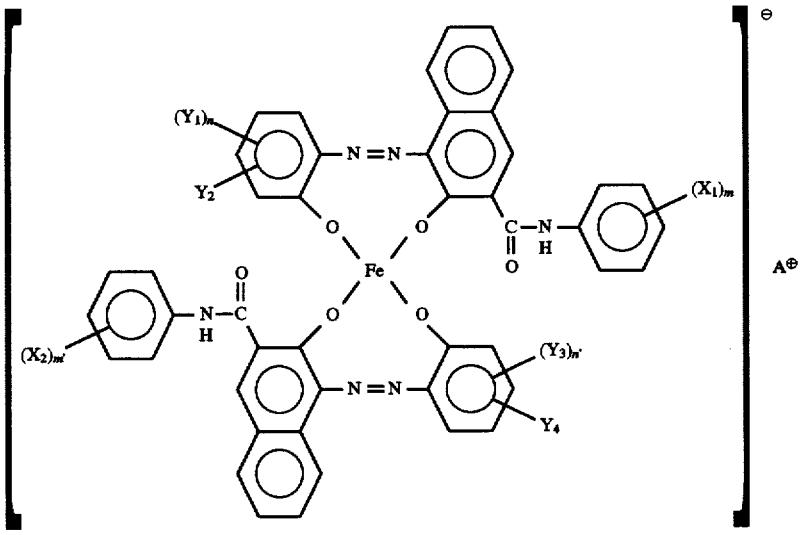

where $X_1$ and X each are a hydrogen atom, a lower alkyl, lower alkoxy, nitro group, or a halogen atom, m and m' each are an integer of 1 to 3, $Y_1$ and $Y_3$ each are a hydrogen atom, an alkyl group of 1 to 18 carbon atoms, an alkenyl group of 2 to 18 carbon atoms, sulfonamide, mesyl, sulfonic acid, a carboxyl ester, a hydroxyl group, an alkoxy group of 1 to 18 carbon atoms, an acetylamino group, a benzoyl group, an amino group or a halogen atom, n and n' each are an integer of 1 to 3

$Y_2$ and $Y_4$ each are a hydrogen atom or a nitro group, $X_1$ and $X_2$, m and m', $Y_1$ and $Y_3$, n and n', and $Y_2$ and $Y_4$ each are identical or different, and $A^+$ is $H^+$, $Na^+$, $K^+$ or $NH_4^+$ or combined ions thereof.

22. The developer according to claim 20, wherein the toner particles contain as a negative charge controlling agent a compound of the formula,

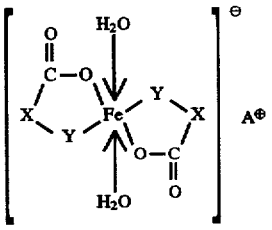

where X is

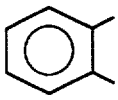

which is substituted or unsubstituted,

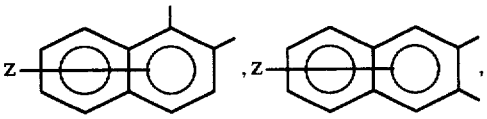

-continued

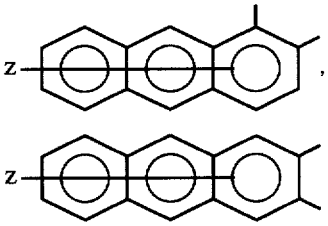

in which Z is a hydrogen, halogen atom, or a nitro group,

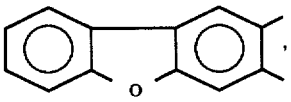

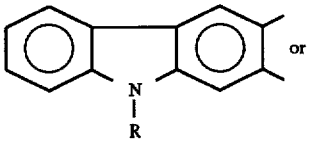

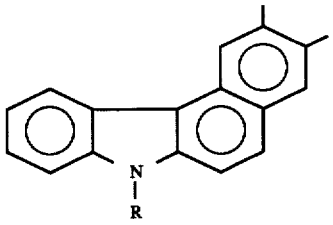

where R is a hydrogen atom, an alkyl group of 1 to 18 carbon atoms, or an alkenyl group of 2 to 18 carbon atoms, Y is —O—, or

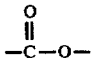

$A^+$ is $H^+$, $Na^+$, $NH_4^+$, aliphatic ammonium or combined ions thereof.

23. The developer according to claim 20, wherein the toner particles contain as a negative charge controlling agent a compound of the formula,

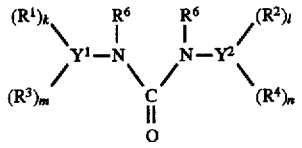

where $Y_1$ and $Y_2$ each are a phenyl, naphtyl or anthryl group, $R^1$ and $R^2$ each are a halogen atom, or a nitro, sulfonate, carboxyl, carboxylate ester, cyano, carbonyl, alkyl, alkoxy or amino group, $R^3$ and $R^4$ each are a hydrogen atom, or an alkyl, alkoxy, phenyl which may have a substituent, aralkyl which may have a substituent or amino group, $R^5$ and $R^6$ each are a hydrogen atom or an hydrocarbon group of 1 to 8 carbon atoms, k and j each are 0 or an integer of 1 to 3, both parameters being not zero at the same time, m and n each are an integer of 1 or 2, and $Y^1$ and $Y^2$, $R^1$ and $R^2$, $R^3$ and $R^4$, $R^5$ and $R^6$, k and j, and m and n each are identical or different.

24. The developer according to claim 20, wherein the toner particles contain as a negative charge controlling agent a compound of the formula,

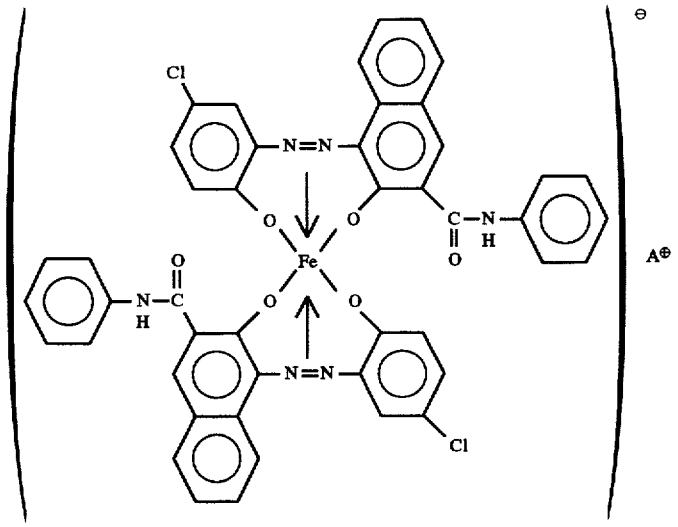

where $A^+$ is $H^+$, $Na^+$, $K^+$ or $NH_4^+$, or combined ions thereof.

25. The developer according to claim 20, wherein the toner particles contain as a negative charge controlling agent a compound of the formula,

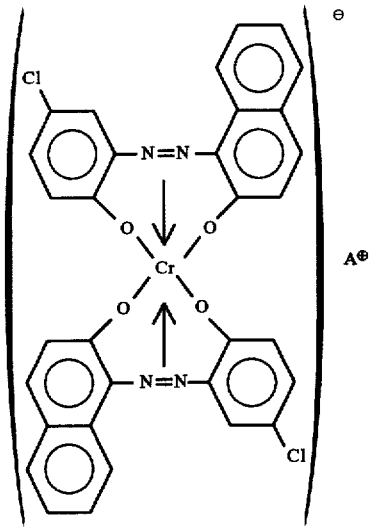

where $A^+$ is $H^+$, $Na^+$, $K^+$ or $NH_4^+$, or combined ions thereof.

26. The developer according to claim 20, wherein the toner particles contain as a negative charge controlling agent a compound of the formula,

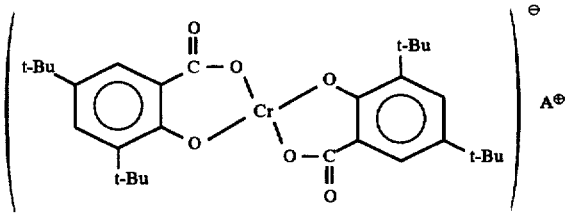

where t-Bu is a t-butyl group, and $A^+$ is $H^+$, $Na^+$, $K^+$ or $NH_4^+$, or combined ions thereof.

27. The developer according to claim 20, wherein the toner particles contain as a negative charge controlling agent a compound of the formula,

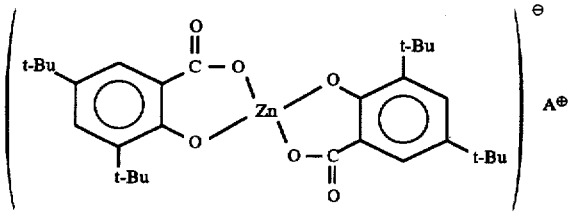

where t-Bu is a t-butyl group, and $A^+$ is $H^+$, $Na^+$, $K^+$ or $NH_4^+$, or combined thereof.

28. An image forming method comprising electrifying an electrostatic image carrying member, exposing the electrified carrying member to light so as to form an elecrostatic image thereon, developing the resulting image with use of a developer so as to form a toner image, transferring the toner image to a transfer material optionally through an intermediate transfer material, and subsequently fixing the image on the transfer material by application of heat and pressure, wherein the developer comprises a toner comprising a particulate toner, a particulate silica A and a particulate silica B, the toner having a weight-average particle size of not larger than 12.0 μm and a particle-number distribution showing not more than 50% of toner particles not larger than 4.0 μm in particle size and not more than 10% of toner particles not smaller than 10.08 μm in particle size, each of the toner particles being formed of a toner composition comprising at least a polymer component and a charge controlling agent, the particulate silica A being composed of silicone oil-treated silica particles and having an average particle size of smaller not larger 0.1 μm, the particulate silica B being composed of silicone oil-treated silica particles and having an average particle size of 0.5 to 50 μm and a particle-number distribution showing not more than 50% of silica particles not larger than 1.0 μm in particle size and not more than 10% of silica particles not smaller than 100 μm in particle size, the particulate silica A and particulate silica B meeting the following requirements, (a) the average particle size $D_B$ of the particulate silica B 10 times or more is larger than the average particle size $D_A$ of the particulate silica A, (b) the silicone oil amount $W_B$ used to treat the particulate silica B is twice or more larger than the silicone oil amount $W_A$ used to that the particulate silica A, and (c) the particulate silica A is added in an amount 3 times or more larger than the particulate silica B with respect to the toner particles (based on weight).

29. The method according to claim 28, wherein said developer employs from 0.3 to 3.0% by weight of the particulate silica A and from 0.005 to 0.5% by weight of the particulate silica B.

30. The method according to claim 28, wherein said electrostatic image carrying member is charged by a contact-type charging means which is biased.

31. The method according to claim 30, wherein said contact-type charging means comprises a charging roller.

32. The method according to claim 30, wherein said contact-type charging means comprises a charging brush.

33. The method according to claim 30, wherein said contact-type charging means comprises a charging blade.

34. The method according to claim 28, wherein said developer is carried by a developer carrying member, said developer carrying member comprising at least a substrate and a coating layer which coats a surface of said substrate, said coating layer being formed of a coating agent which comprises: (i) a mixture of a solid lubricant, a conducting agent or a mixture of a solid lubricant and a conducting agent; and (ii) a binding resin.

35. The method according to claim 28, wherein said toner image is transferred to said transfer material by means of a transfer roller which is biased.

36. The method according to claim 28, wherein said toner image is transferred to said transfer material by means of a transfer roller which is biased.

37. The method according to claim 28, wherein said toner image on said transfer material is fixed thereto by a heat-press-fixing means which comprises a heating roller and a pressing roller.

38. The method according to claim 28, wherein said toner image on said transfer material is fixed by a linear heating member which is fixed and supported through a film.

* * * * *

UNITED STATES PATENT AND TRADEMARK OFFICE

CERTIFICATE OF CORRECTION

PATENT NO. : 5,700,616

DATED : December 23, 1997

INVENTOR(S): KASUYA ET AL.

It is certified that error appears in the above-identified patent and that said Letters Patent is hereby corrected as shown below:

COLUMN 1

Line 66, "Electro-statically" should read --electrostatically--.

COLUMN 2

Line 17, "to" should read --to the--;
Line 18, "to" should read --to the--;
Line 28, "at" should read --should be deleted--;
Line 46, delete "dilemmatic".

COLUMN 5

Line 26, "transfer-ability" should read --transferability--;
Line 54, "of" (first occurrence) should read --or--.

COLUMN 6

Line 54, "transfer-ability" should read --transferability--.

COLUMN 8

Line 45, "in" should read --in a--.

COLUMN 9

Line 30, "(W $_1$g)" should read --($W_1$g)--.z

UNITED STATES PATENT AND TRADEMARK OFFICE

CERTIFICATE OF CORRECTION

PATENT NO. : 5,700,616

DATED : December 23, 1997

INVENTOR(S): KASUYA ET AL.

It is certified that error appears in the above-identified patent and that said Letters Patent is hereby corrected as shown below:

COLUMN 10

Line "36, "weigjt" should read --weight--;
Line 43, "fixint" should read --fixing--;
Line 45, "vales" should read --values--;
Line 64, "$W_L$:$W_E$=50:50 to 90:10" should read --$W_L$:$W_H$=50:50 to 90:10--.

COLUMN 11

Line 48, "be" should be deleted.

COLUMN 12

Line 36, "acid" should read --acids--;
Line 41, "anhyrous" should read --anhydrous--.

COLUMN 13

Line 15, "is" should be deleted;
Line 24, "become" should read --becomes--;
Line 30, "are" should read --is--;

COLUMN 17

Line 39, "dodecy" should read --dodecyl--;
Line 44, "dodecy" should read --dodecyl--.

UNITED STATES PATENT AND TRADEMARK OFFICE

CERTIFICATE OF CORRECTION

PATENT NO. : 5,700,616

DATED : December 23, 1997

INVENTOR(S): KASUYA ET AL.

It is certified that error appears in the above-identified patent and that said Letters Patent is hereby corrected as shown below:

COLUMN 18

Line 21, "trimethyldhlorosilane," should read --trimethyldichlorosilane,--;
Line 66, "agents" should read --agents are--.

COLUMN 21

Line 7, "hyroxyl" should read --hydroxyl--;
Line 12, "an" should read --a--.

COLUMN 22

Line 52, "an" should read --a--.

COLUMN 23

Line 36, "triphenymethane" should read --triphenylmethane--;
Line 38, "molydenic" should read --molybdenic--;
Line 51, "as" (second occurrence) should be deleted.

COLUMN 25

Line 14, "from" should be deleted;
Line 18, "allowed" should read --is allowed--.

UNITED STATES PATENT AND TRADEMARK OFFICE

CERTIFICATE OF CORRECTION

PATENT NO. : 5,700,616

DATED : December 23, 1997

INVENTOR(S): KASUYA ET AL.

It is certified that error appears in the above-identified patent and that said Letters Patent is hereby corrected as shown below:

COLUMN 27

Line 3, "of" should read --of the--;
Line 54, "71" should read --71 is--;
Line 61, "form" should read --form of--.

COLUMN 29

Line 16, "powder(BET-specific" should read --powder (BET-specific--.

COLUMN 35

Line 25, "remolding)," should read --remodeling--;

Lines 31 and 32, "coated was" should read --was coated on--;
Line 54, "Figging" should read --Fogging--;
Line 55, "reflecmeter" should read --reflectometer--.

COLUMN 39

Line 23, "evbaluate" should read --evaluate--.

UNITED STATES PATENT AND TRADEMARK OFFICE

CERTIFICATE OF CORRECTION

PATENT NO. : 5,700,616

DATED : December 23, 1997

INVENTOR(S): KASUYA ET AL.

It is certified that error appears in the above-identified patent and that said Letters Patent is hereby corrected as shown below:

COLUMN 40

Line 46, "that" should read --treat--.

COLUMN 42

Line 27, "With" should read --with--;
Line 30, delete "smaller";
Line 55, "boelectrific" should read --boelectric--.

COLUMN 44

Line 35, "hydrogen," should read --hydrogen or--.

COLUMN 45

Line 4, " 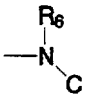 " should read -- 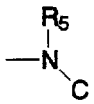 --;

Line 19, "an" should read --a--.

COLUMN 47

Line 32, delete "smaller";
Line 41, "10 times or more is larger" should read --is 10 times or more larger--.

UNITED STATES PATENT AND TRADEMARK OFFICE

CERTIFICATE OF CORRECTION

PATENT NO. : 5,700,616

DATED : December 23, 1997

INVENTOR(S): KASUYA ET AL.

It is certified that error appears in the above-identified patent and that said Letters Patent is hereby corrected as shown below:

COLUMN 48

Line 3, "that" should read --treat--.

Signed and Sealed this

Second Day of May, 2000

*Attest:*

Q. TODD DICKINSON

*Attesting Officer*

*Director of Patents and Trademarks*